US011674510B2

(12) United States Patent
Choi et al.

(10) Patent No.: US 11,674,510 B2
(45) Date of Patent: Jun. 13, 2023

(54) SCROLL COMPRESSOR WITH AXIALLY SLIDABLE SUCTION PASSAGE OPENING AND CLOSING VALVE

(71) Applicant: LG Electronics Inc., Seoul (KR)

(72) Inventors: Jungsun Choi, Seoul (KR); Kangwook Lee, Seoul (KR); Kyungho Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1 day.

(21) Appl. No.: 17/344,469

(22) Filed: Jun. 10, 2021

(65) Prior Publication Data

US 2022/0034557 A1 Feb. 3, 2022

(30) Foreign Application Priority Data

Jul. 30, 2020 (KR) ..... 10-2020-0095506

(51) Int. Cl.
*F04C 18/02* (2006.01)
*F04C 23/00* (2006.01)
*F04C 29/12* (2006.01)

(52) U.S. Cl.
CPC ..... *F04C 18/0215* (2013.01); *F04C 23/008* (2013.01); *F04C 29/12* (2013.01); *F04C 29/126* (2013.01); *F04C 2240/30* (2013.01)

(58) Field of Classification Search
CPC .... F04C 15/064; F04C 15/066; F04C 15/068; F04C 29/124; F04C 29/126; F04C 29/128; F04C 2/025; F04C 18/0207–0292; F04C 1/0207–0292
See application file for complete search history.

(56) References Cited

U.S. PATENT DOCUMENTS 4,560,330 A 12/1985 Murayama et al.
8,814,537 B2 8/2014 Ignatiev et al.
2006/0233657 A1* 10/2006 Bonear ..... F04C 28/28 418/55.6
2010/0189585 A1* 7/2010 Matsukawa ..... F04C 18/0215 418/48

(Continued)

FOREIGN PATENT DOCUMENTS

JP 2010276001 12/2010
JP 2015129468 7/2015

(Continued)

OTHER PUBLICATIONS

Extended European Search Report in European Appln. No. 21176105.1, dated Aug. 11, 2021, 32 pages.

(Continued)

*Primary Examiner* — Laert Dounis
(74) *Attorney, Agent, or Firm* — Fish & Richardson, P.C.

(57) ABSTRACT

A scroll compressor includes a refrigerant suction pipe coupled to a discharge cover or a fixed scroll through a casing in a radial direction, a suction passage communicating the refrigerant suction pipe with a compression chamber, and a suction passage opening and closing valve disposed inside the suction passage to be slidable in an axial direction so as to selectively open or close the suction passage. Accordingly, when the compressor is stopped, oil or refrigerant in the casing can be restricted quickly so as not to flow back to the refrigerant suction pipe through a compression unit.

20 Claims, 19 Drawing Sheets

(56) References Cited

U.S. PATENT DOCUMENTS

| | | | | |
|---|---|---|---|---|
| 2013/0081710 | A1* | 4/2013 | Ignatiev | F04C 29/045 137/565.01 |
| 2015/0192126 | A1* | 7/2015 | Nagano | F04C 18/0215 417/410.5 |
| 2018/0363654 | A1 | 12/2018 | Doepker et al. | |

FOREIGN PATENT DOCUMENTS

| | | |
|---|---|---|
| JP | 2016020687 | 2/2016 |
| KR | 100575700 | 7/2015 |
| KR | 20180101901 | 9/2018 |
| KR | 1020190000070 | 1/2019 |

OTHER PUBLICATIONS

Office Action in Korean Appln. No. 10-2020-0095506, dated Sep. 8, 2021, 10 pages (with English translation).

* cited by examiner

SCROLL COMPRESSOR WITH AXIALLY SLIDABLE SUCTION PASSAGE OPENING AND CLOSING VALVE

CROSS-REFERENCE TO RELATED APPLICATION

Pursuant to 35 U.S.C. § 119(a), this application claims the benefit of the earlier filing date and the right of priority to Korean Patent Application No. 10-2020-0095506, filed on Jul. 30, 2020, the contents of which is incorporated by reference herein in its entirety.

TECHNICAL FIELD

The present disclosure relates to a scroll compressor, and more particularly, a high-pressure and bottom-compression type scroll compressor.

BACKGROUND

A scroll compressor defines a compression chamber including a suction chamber, an intermediate pressure chamber, and a discharge chamber between scrolls while the scrolls is in an engaged state. Compared with other types of compressors, the scroll compressor may obtain a relatively high compression ratio and stable torque, resulting from smooth connection of suction, compression, and discharge strokes of refrigerant. Therefore, the scroll compressors are widely used for compressing refrigerant in air conditioners or the like.

Scroll compressors may be classified into a low-pressure type and a high-pressure type according to a position at which a refrigerant suction pipe communicates. A refrigerant suction pipe in a low-pressure scroll compressor communicates with an inner space of a casing, while a refrigerant suction pipe in a high-pressure scroll compressor communicates directly with a compression unit.

Accordingly, in the low-pressure scroll compressor, the inner space of the casing defines a low-pressure part, which is a suction space, whereas in the high-pressure scroll compressor, the inner space of the casing defines a high-pressure part, which is a discharge space.

In particular, in the low-pressure scroll compressor, the refrigerant suction pipe is separated from the compression part and, the inner space of the casing defines the low-pressure part. When the low-pressure scroll compressor is stopped, it is relatively less likely that oil in the casing flows back to the refrigerant suction pipe together with residual refrigerant in a compression chamber.

However, in the high-pressure scroll compressor, the refrigerant suction pipe is connected to the compression unit, and the inner space of the casing defines the high-pressure part. When the high-pressure scroll compressor is stopped, oil in the casing may flow back to the refrigerant suction pipe through the compression unit together with the residual refrigerant in the compression chamber.

This may occur more severely in a bottom-compression type scroll compressor than in a top-compressor type scroll compressor. In the bottom-compression type scroll compressor, the compression unit is located below a motor unit so as to be adjacent to an oil storage space within the casing. In the top-compression type scroll compressor, which the compression unit is located above the motor unit.

Accordingly, it is desirable to install a check valve for selectively opening and closing a suction passage in the top-compression type scroll compressor as well as the bottom-compression type scroll compressor. In some examples, a check valve may be disposed between an inlet port and a refrigerant suction pipe in a top-compression type scroll compressor.

In other examples, a check valve may be disposed on a suction passage in a bottom-compression type scroll compressor.

In some example compressors, the check valve is installed in an accumulator connected to the refrigerant suction pipe. In other example compressors, the check valve is installed on a fixed scroll inside a casing.

However, in such example compressors, responsiveness of the check valve may be lowered, and a separate elastic member is added due to a structure in which the check valve is opened while moving downward.

In addition, in such example compressors, an oil leakage or an increase in a specific volume of suction refrigerant may be caused due to a generation of a gap, through which oil or refrigerant is likely to flow backward, at least between the check valve and a compression unit, which results from that the check valve is disposed outside the casing.

In addition, in such example compressors, responsiveness of the check valve may be lowered, and a separate elastic member is added due to a structure in which the check valve is installed inside the casing but operates in a radial direction.

SUMMARY

One aspect of the present disclosure is to provide a scroll compressor, capable of restricting oil or refrigerant inside a casing from flowing back to a refrigerant suction pipe through a compression unit, in a structure in which the compression unit is located below a motor unit and the refrigerant suction pipe is directly connected to the compression unit through the casing.

Another aspect of the present disclosure is to provide a scroll compressor that includes a suction passage connecting a refrigerant suction pipe and a compression unit to each other, even without extending a length of the compressor.

Still another aspect of the present disclosure is to provide a scroll compressor, in which a suction passage can be defined by using a lower space of a compression unit in an inner space of a casing and a valve for selectively opening or closing the suction passage according to whether the compressor operates or not can be installed.

Still another aspect of the present disclosure is to provide a scroll compressor, capable of enhancing responsiveness of a valve for opening or closing a suction passage while simplifying a structure of the valve.

Still another aspect of the present disclosure is to provide a scroll compressor, capable of smoothly supplying oil inside a casing to a compression unit by forming an oil supply portion for supplying the oil to the compression unit and restricting the oil from leaking to a refrigerant suction pipe through the oil supply portion.

To achieve these and other advantages and in accordance with the purpose of this specification, particular implementations of the present disclosure provide a scroll compressor that includes a casing, a main frame provided in the casing, a fixed scroll, an orbiting scroll, a discharge cover, a refrigerant suction pipe, a suction passage, and a suction passage opening and closing valve. The fixed scroll has (i) a fixed end plate coupled to the main frame, (ii) a fixed wrap defined at a first side surface of the fixed end plate, and (iii) a discharge port defined through the fixed end plate at a side of the fixed wrap. The orbiting scroll has (i) an orbiting end plate located between the main frame and the fixed scroll, and (ii) an orbiting wrap defined at a side surface of the orbiting end plate. The orbiting wrap is configured to engage with the fixed wrap to thereby define a compression chamber in engagement with the fixed wrap. The discharge cover defines a discharge space that accommodates an outlet of the discharge port. The discharge cover is coupled to a second side surface of the fixed end plate opposite to the first side surface of the fixed end plate. The refrigerant suction pipe is coupled to the discharge cover or the fixed scroll through the casing in a radial direction. The suction passage is in fluid communication with the refrigerant suction pipe and the compression chamber. The suction passage opening and closing valve is provided inside the suction passage and configured to slide in an axial direction to thereby selectively open or close the suction passage.

In some implementations, the scroll compressor can optionally include one or more of the following features. The refrigerant suction pipe may be coupled to the discharge cover or the fixed scroll at an axial height that is different from an axial height of the compression chamber. The suction passage may include first and second suction passages. The first suction passage may be defined at the discharge cover and connected to the refrigerant suction pipe. The second suction passage may be defined at the fixed scroll and have first and second ends. The first end may be in fluid communication with the first suction passage, and the second end may be in fluid communication with the compression chamber. The suction passage opening and closing valve may be inserted into the second suction passage and configured to slide in the axial direction. The discharge cover may include a housing portion having the discharge space that accommodates the discharge port, and a suction guide protrusion protruding from a side wall surface of the housing portion toward a central portion of the discharge space. The first suction passage may extend between (i) a radial side surface of the discharge cover facing an inner circumferential surface of the casing and (ii) an axial side surface of the discharge cover facing the fixed scroll. The fixed scroll may include a fixed side wall portion defined at an edge of the fixed end plate. The fixed side wall portion may have an annular shape. The second suction passage may be recessed between the fixed side wall portion and an outer surface of an outermost fixed wrap facing the fixed side wall portion. The second suction passage may be partially defined at an inner circumferential surface of the fixed side wall portion. The second suction passage may be recessed in the radial direction. The fixed side wall portion may include a valve stopper defined at an end of the inner circumferential surface and configured to support the suction passage opening and closing valve. The second suction passage may have an inlet defined through the fixed end plate toward the first suction passage. The second suction passage may have an outlet that faces the outer surface of the outermost fixed wrap. An axial center of the first suction passage and an axial center of the second suction passage may be disposed to be eccentric to each other to thereby define a valve seat surface at a boundary surface between the first suction passage and the second suction passage. A sealing member may be provided between an end surface of the first suction passage and an end surface of the second suction passage. The end surface of the second suction passage may face the end surface of the first suction passage. An axial center of the sealing member may be eccentric with respect to the axial center of the first suction passage or the axial center of the second suction passage. An axial center of the first suction passage and an axial center of the second suction passage may be aligned with each other. The first suction passage may have an inner diameter smaller than an inner diameter of the second suction passage to thereby define a valve seat surface at an end surface of the first suction passage. The suction passage may include a first suction passage defined at the fixed scroll and connected to the refrigerant suction pipe, and a second suction passage defined at the fixed scroll and having first and second ends. The first end may be in fluid communication with the first suction passage, and the second end may be in fluid communication with the compression chamber. The suction passage opening and closing valve may be inserted into the second suction passage and configured to slide in the axial direction. The fixed scroll may include a suction guide protrusion extending from the fixed end plate toward the discharge cover in the axial direction. At least part of the first suction passage may be defined through the suction guide protrusion. The suction guide protrusion may be spaced apart from a side surface of the discharge cover. The first suction passage may have an inner diameter smaller than an inner diameter of the second suction passage to thereby define a valve seat surface at an end surface of the first suction passage. The second suction passage may be partially defined at an inner circumferential surface of a fixed side wall portion of the fixed scroll. The second suction passage may be recessed in the radial direction. The fixed side wall portion may include a valve stopper coupled to an end of the inner circumferential surface and configured to support the suction passage opening and closing valve in the axial direction. The suction passage opening and closing valve may include a valve body portion having a plate shape and configured to open and close the suction passage, and a valve guide portion extending in the axial direction from the valve body portion. The valve guide portion may have an annular shape and is defined at an edge of the valve body portion. The valve guide portion may have an outer diameter less than or equal to an outer diameter of the valve body portion. The valve guide portion may include at least one communication groove defined at an end surface of the valve guide portion. The valve guide portion may extend between an outer circumferential surface and an inner circumferential surface of the valve guide portion. The suction passage opening and closing valve may have opposite side surfaces extending in the axial direction and having a flat plate shape. The suction passage opening and closing valve may have a refrigerant accommodating space that is recessed at a first side surface of the suction passage opening and closing valve. The first side surface of the suction passage opening and closing valve is opposite, in the axial direction, to a second side surface of the suction passage opening and closing valve that faces the refrigerant suction pipe. The scroll compressor may include an elastic member disposed between the suction passage opening and closing valve and the second suction passage. The second suction passage may face the suction passage opening and closing valve and be configured to support the suction passage opening and closing valve in a closing direction.

To achieve these and other advantages and in accordance with the purpose of this specification, as embodied and broadly described herein, there is provided a scroll compressor, including a compression unit provided inside a casing, a refrigerant suction pipe directly connected to the compression unit through the casing, and a non-return valve provided between the compression unit and the refrigerant suction pipe to block a fluid flowing backward from the compression unit to the refrigerant suction pipe. With this configuration, oil in the casing can be effectively restricted from flowing back into the refrigerant suction pipe through the compression unit, thereby decreasing suction loss of refrigerant suctioned into the casing and simultaneously reducing friction loss due to an oil leakage.

Here, the no-return valve may be operated in a direction orthogonal to a direction in which the refrigerant suction pipe is inserted through the casing. Accordingly, the non-return valve can be installed even without increasing a length of the compressor.

The refrigerant suction pipe may be coupled through the casing in a radial direction, and the no-return valve may be operated in an axial direction. With the configuration, the non-return valve can be operated by its own weight, thereby simplifying a structure of the valve and improving responsiveness of the valve.

In addition, the refrigerant suction pipe may be connected to the compression unit through the casing at a position lower than an axial height of the compression unit, and the no-return valve may be operated at a position higher than a height at which the refrigerant suction pipe is connected. This may allow the non-return valve to quickly block a suction passage between the refrigerant suction pipe and the compression unit when the compressor is stopped.

In addition, to achieve these and other advantages and in accordance with the purpose of this specification, as embodied and broadly described herein, there is provided a scroll compressor, including a motor unit fixed to an inner space of a casing, a compression unit located below the motor unit and having a compression chamber, a discharge passage to guide refrigerant discharged from the compression unit to an upper side of the motor unit, and a discharge cover provided below the compression unit and having a discharge space to guide refrigerant discharged from the compression chamber toward the discharge passage. The refrigerant suction pipe may be connected to the discharge cover. With the configuration, as a suction passage is defined using a lower space of a bottom-compression type scroll compressor, a valve installation space can be secured between the refrigerant suction pipe and the compression unit even without increasing a length of the compressor.

Here, a first suction passage may be formed in the discharge cover and a second suction passage communicating with the first suction passage of the discharge cover may be formed in the compression unit. This may facilitate formation of a suction passage.

Further, a suction valve may be provided between the first suction passage and the second suction passage to allow a fluid movement from the first suction passage to the second suction passage and block a fluid movement from the second suction passage to the first suction passage. This may facilitate installation of the suction valve.

To achieve these and other advantages and in accordance with the purpose of this specification, as embodied and broadly described herein, there is provided a scroll compressor, including a casing, a main frame provided in an inner space of the casing, a fixed scroll having a fixed end plate coupled to the main frame, a fixed wrap formed on one side surface of the fixed end plate, and a discharge port formed through the fixed end plate at one side of the fixed wrap, an orbiting scroll having an orbiting end plate located between the main frame and the fixed scroll, and an orbiting wrap formed on one side surface of the orbiting end plate so as to define a compression chamber in engagement with the fixed wrap, a discharge cover provided with a discharge space to accommodate the discharge port and coupled to another side surface of the fixed end plate, a refrigerant suction pipe coupled to the discharge cover or the fixed scroll through the casing, a suction passage communicating between the refrigerant suction pipe and the compression chamber, and a suction passage opening and closing valve provided inside the suction passage to selectively open or close the suction passage. With the configuration, in a bottom-compression type scroll compressor, when the compressor is stopped, oil or refrigerant can be blocked from flowing back toward a suction side, thereby suppressing suction loss and friction loss due to a shortage of oil.

Here, the refrigerant suction pipe may be connected to the suction passage through the casing in a radial direction, and the suction passage opening and closing valve may be slidably coupled to the suction passage in the axial direction. With the configuration, the suction passage opening and closing valve can secure its operation space and can be operated by its own weight, which may result in simplifying a structure of the valve and improving responsiveness of the valve.

The refrigerant suction pipe may be coupled to the discharge cover or the fixed scroll at an axial height different from that of the compression chamber. This may allow installation of the suction passage opening and closing valve without increasing a length of the compressor.

The suction passage may include a first suction passage formed in the discharge cover to be connected the refrigerant suction pipe, and a second suction passage formed in the fixed scroll and having one end communicating with the first suction passage and another end communicating with the compression chamber. The suction passage opening and closing valve may be slidably inserted into the second suction passage in the axial direction. With the configuration, an inlet of the suction passage may be formed at a side surface in the radial direction and an outlet may be formed at a side surface in the axial direction, such that the suction passage opening and closing valve can be installed to operate in the axial direction.

The discharge cover may be provided with a housing portion having a discharge space to accommodate the discharge port, and a suction guide protrusion protruding from a side wall surface of the housing portion toward a central portion of the discharge space. The first suction passage may be formed through the suction guide protrusion. Accordingly, the first suction passage can be easily formed.

The first suction passage may be formed in a penetrating manner between a radial side surface of the discharge cover facing an inner circumferential surface of the casing and an axial side surface of the discharge cover facing the fixed scroll.

The first suction passage may be provided with a suction guide surface formed on an inner circumferential surface thereof in an inclined or bent manner. This structure can restrict vortex of refrigerant suctioned into the first suction passage, thereby reducing suction loss of the refrigerant.

The fixed scroll may be provided with a fixed side wall portion formed in an annular shape on an edge of the fixed end plate, and the second suction passage may be recessed by a preset depth between the fixed side wall portion and an outer surface of an outermost fixed wrap facing the fixed side wall portion. Accordingly, the second suction passage can be formed at the outermost side so as to secure a wide volume of the compression chamber.

The second suction passage may be partially formed in an inner circumferential surface of the fixed side wall portion in a manner of being recessed in the radial direction, and the fixed side wall portion may be provided with a valve stopper formed on an end of the inner circumferential surface to support the suction passage opening and closing valve. This may facilitate formation of a stopper for limiting an open position of the suction passage opening and closing valve.

The second suction passage may have an inlet formed through the fixed end plate toward the first suction passage, and an outlet facing the outer surface of the outermost fixed wrap. As the outlet of the suction passage is formed on a surface orthogonal to an opening and closing direction of the suction passage opening and closing valve, the suction passage can be quickly opened when the suction passage opening and closing valve moves to the open position.

The second suction passage may have an outlet height greater than a thickness of the suction passage opening and closing valve. This may result in securing a wide area of the suction passage.

An axial center of the first suction passage and an axial center of the second suction passage may be disposed to be eccentric to each other, so that a valve seat surface can be defined at a boundary surface between the first suction passage and the second suction passage. This may facilitate formation of the valve seat surface.

The first suction passage may have an inner diameter greater than or equal to an inner diameter of the second suction passage. Accordingly, the valve seat surface can be easily formed and a wide area of the suction passage can be secured.

A sealing member may be provided between an end surface of the first suction passage and an end surface of the second suction passage facing the end surface of the first suction passage, and an axial center of the sealing member may be eccentric with respect to the axial center of the first suction passage or the axial center of the second suction passage. Accordingly, a sealing distance between the suction passages can be secured, thereby sealing the suction passages tightly.

An axial center of the first suction passage and an axial center of the second suction passage may be disposed on the same axial line, and the first suction passage may have an inner diameter smaller than an inner diameter of the second suction passage, so that a valve seat surface can be defined on an end surface of the first suction passage. This may more facilitate the formation of the valve seat surface.

The suction passage may include a first suction passage formed in the fixed scroll to be connected the refrigerant suction pipe, and a second suction passage formed in the fixed scroll and having one end communicating with the first suction passage and another end communicating with the compression chamber. The suction passage opening and closing valve may be slidably inserted into the second suction passage in the axial direction. Accordingly, the suction passage can all be formed in the fixed scroll, which may more facilitate the formation of the suction passage.

The fixed scroll may be provided with a suction guide protrusion extending from the fixed end plate toward the discharge cover in the axial direction, and at least part of the first suction passage may be formed through the suction guide protrusion.

The suction guide protrusion may be spaced apart from a side surface of the discharge cover by a preset interval. This may result in suppressing refrigerant suctioned through the suction passage from being heated by high-temperature refrigerant discharged into the discharge space of the discharge cover.

The first suction passage may have an inner diameter smaller than an inner diameter of the second suction passage, so that a valve seat surface can be defined on an end surface of the first suction passage.

In addition, the fixed scroll may be provided with a fixed side wall portion formed in an annular shape on an edge of the fixed end plate, and the second suction passage may be recessed by a preset depth in a direction toward an end of the fixed wrap between the fixed side wall portion and an outer surface of an outermost fixed wrap facing the fixed side wall portion.

The second suction passage may be partially formed in an inner circumferential surface of the fixed side wall portion in a manner of being recessed in the radial direction, and the fixed side wall portion may be provided with a valve stopper coupled to an end of the inner circumferential surface to support the suction passage opening and closing valve in the axial direction. This may result in collectively forming the suction passage in the fixed scroll and effectively limiting an open position of the suction passage opening and closing valve.

The suction passage opening and closing valve may include a valve body portion formed in a plate shape to open and close the suction passage, and a valve guide portion extending in the axial direction from the valve body portion. The valve guide portion may be formed in an annular shape at an edge of the valve body portion. With the configuration, a support area of the suction passage opening and closing valve can be secured to stabilize a behavior of the valve. Simultaneously, a space for accommodating refrigerant can be defined in a rear surface of the valve so as to improve responsiveness of the valve.

The valve guide portion may have an outer diameter smaller than or equal to an outer diameter of the valve body portion. Accordingly, a support area of the suction passage opening and closing valve can be secured and a friction area can be reduced, thereby stabilizing the behavior of the valve and further improving responsiveness of the valve.

The valve guide portion may be provided with at least one communication groove formed in an end surface thereof to penetrate between an outer circumferential surface and an inner circumferential surface of the valve guide portion. This may allow refrigerant to quickly flow to a rear surface of the valve, thereby further improving responsiveness of the valve.

The suction passage opening and closing valve may have both side surfaces in the axial direction in a flat plate shape. This may simplify the structure of the suction passage opening and closing valve and reduce a fabricating cost.

The suction passage opening and closing valve may have a refrigerant accommodating space by being recessed by a preset depth into one side surface opposite to another side surface facing the refrigerant suction pipe, of both side surfaces in the axial direction. Accordingly, a structure of the valve can be simplified and responsiveness of the valve can be improved by virtue of a space formed in a rear surface of the valve for accommodating refrigerant.

The scroll compressor may further include an elastic member disposed between the suction passage opening and closing valve and the second suction passage facing the same to support the suction passage opening and closing valve in a closing direction. This may allow the valve to be quickly closed, thereby further improving responsiveness of the valve.

Here, a driving motor may be provided in an inner space of the casing and coupled to the orbiting scroll by a rotating shaft. A lower end portion of the rotating shaft may be rotatably coupled sequentially through the main frame, the orbiting scroll, the fixed scroll, and the discharge cover. An oil supply portion may be provided between the inner space of the casing and the compression chamber defined in the inner space of the casing to guide oil in the casing to the compression chamber through the rotating shaft. The suction passage opening and closing valve may be located at an upstream side rather than an outlet of the oil supply portion based on a flowing direction of refrigerant. With the configuration, in a bottom-compression type scroll compressor, the oil in the casing can be effectively be restricted from flowing back to a suction side through the oil supply portion.

In addition, the oil supply portion may include an oil supply path formed from a lower end of the rotating shaft to an outer circumferential surface of the rotating shaft in a penetrating manner, and an oil supply hole formed through the orbiting scroll to communicate with the oil supply path. An outlet of the oil supply hole may penetrate through the orbiting end plate at a rotating angle which is greater than a rotating angle at which a suction of the compression chamber is completed. With the configuration, refrigerant which is suctioned can be suppressed from being heated due to oil supplied to the compression unit through the oil supply portion, thereby reducing suction loss.

The oil supply hole may be provided in plurality spaced apart from one another. Outlets of the plurality of oil supply holes may be spaced apart by preset intervals from an outer surface and an inner surface of an outermost orbiting wrap of the orbiting scroll. Accordingly, oil can be uniformly supplied to both compression chambers.

DETAILED DESCRIPTION

Description will now be given in detail of a scroll compressor according to exemplary embodiments disclosed herein, with reference to the accompanying drawings.

Hereinafter, a description will be given by defining an axial direction and a radial direction based on a rotating shaft. That is, for the sake of explanation, a lengthwise direction of a rotating shaft is defined as the axial direction (or gravity direction) of the compressor, and a transverse direction of the rotating shaft is defined as a radius of the compressor.

A bottom-compression type scroll compressor is primarily described herein, which is a vertical type scroll compressor with a motor unit and a compression unit arranged in a vertical direction in a manner that the compression unit is located below the motor unit. In addition, a high-pressure type scroll compressor is primarily described herein, which is a bottom-compression type and has a refrigerant suction pipe directly connected to the compression unit and a refrigerant discharge pipe being in fluid communication with an inner space of a casing.

Figure 1:
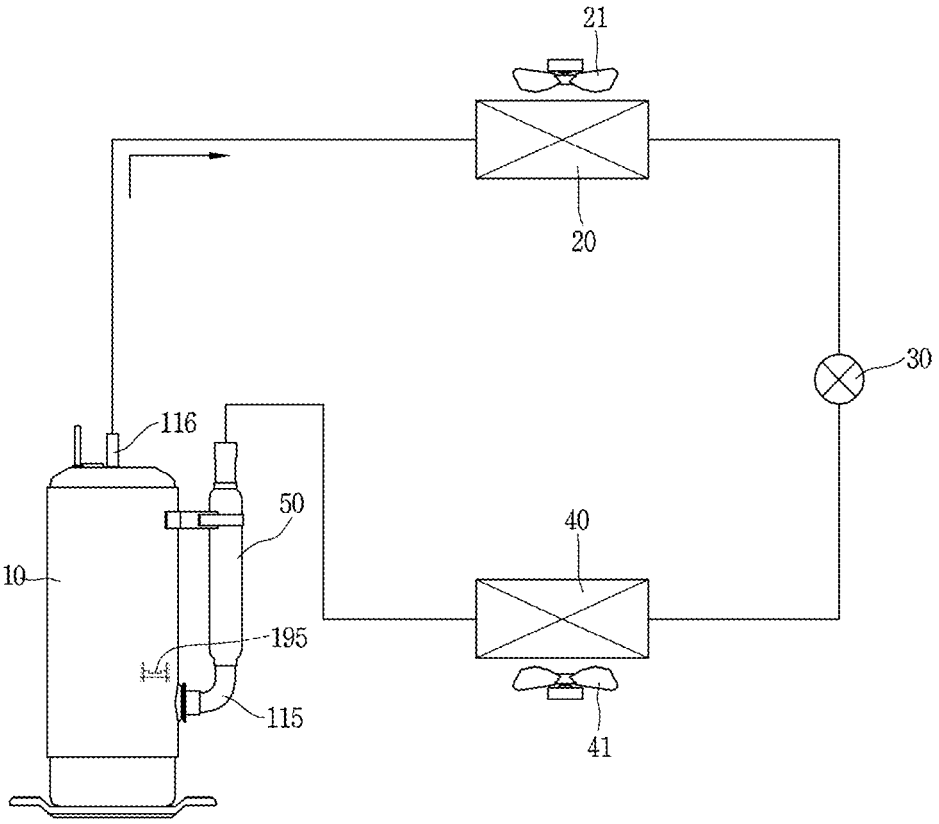
FIG. 1 is a diagram illustrating a refrigeration cycle system including a bottom-compression type scroll compressor in accordance with implementations of the present disclosure.

FIG. 1 is a diagram illustrating a refrigeration cycle system that includes a bottom-compression type scroll compressor in accordance with implementations of the present disclosure.

Referring to FIG. 1, the refrigeration cycle system may include a compressor 10, a condenser 20, an expansion apparatus 30, and an evaporator 40, which define a closed loop. The condenser 20, the expansion apparatus 30, and the evaporator 40 may be sequentially connected to a discharge side of the compressor 10 and a discharge side of the evaporator 40 may be connected to a suction side of the compressor 10.

Accordingly, refrigerant compressed in the compressor 10 may be discharged toward the condenser 20, and then suctioned back into the compressor 10 sequentially through the expansion apparatus 30 and the evaporator 40. The series of processes may be repeatedly carried out.

Figure 2:
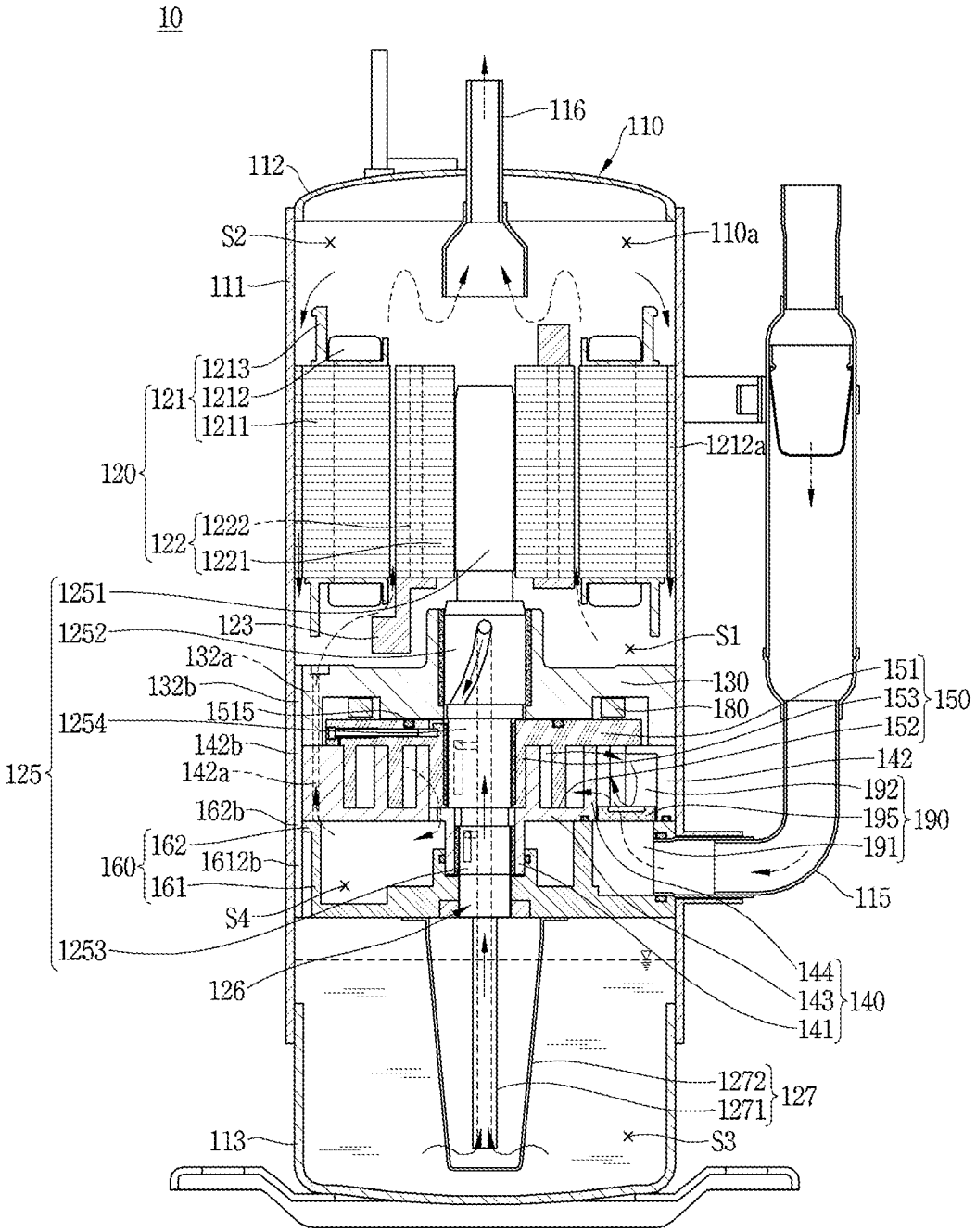
FIG. 2 is a longitudinal sectional view of a bottom-compression type scroll compressor in accordance with implementations of the present disclosure.
Figure 3:
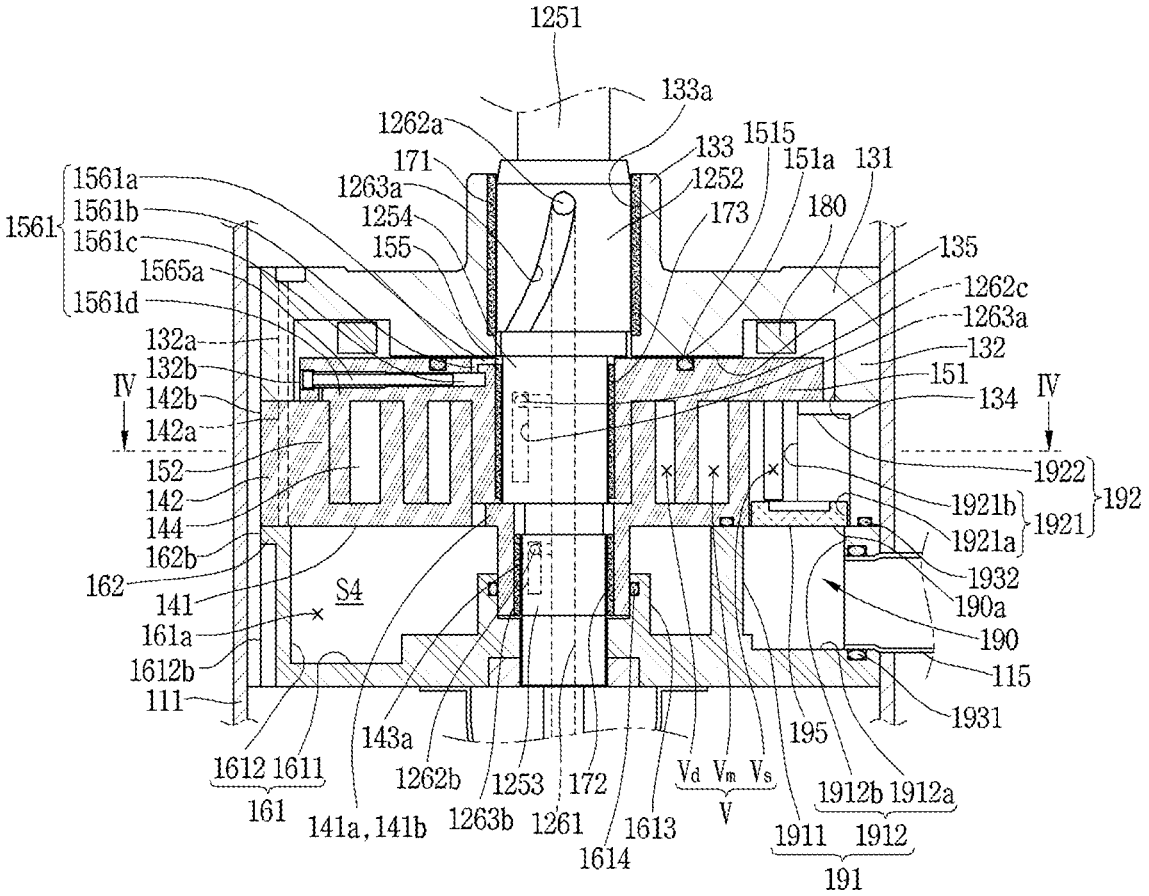
FIG. 3 is an enlarged longitudinal sectional view of a compression unit in FIG. 2.
Figure 4:
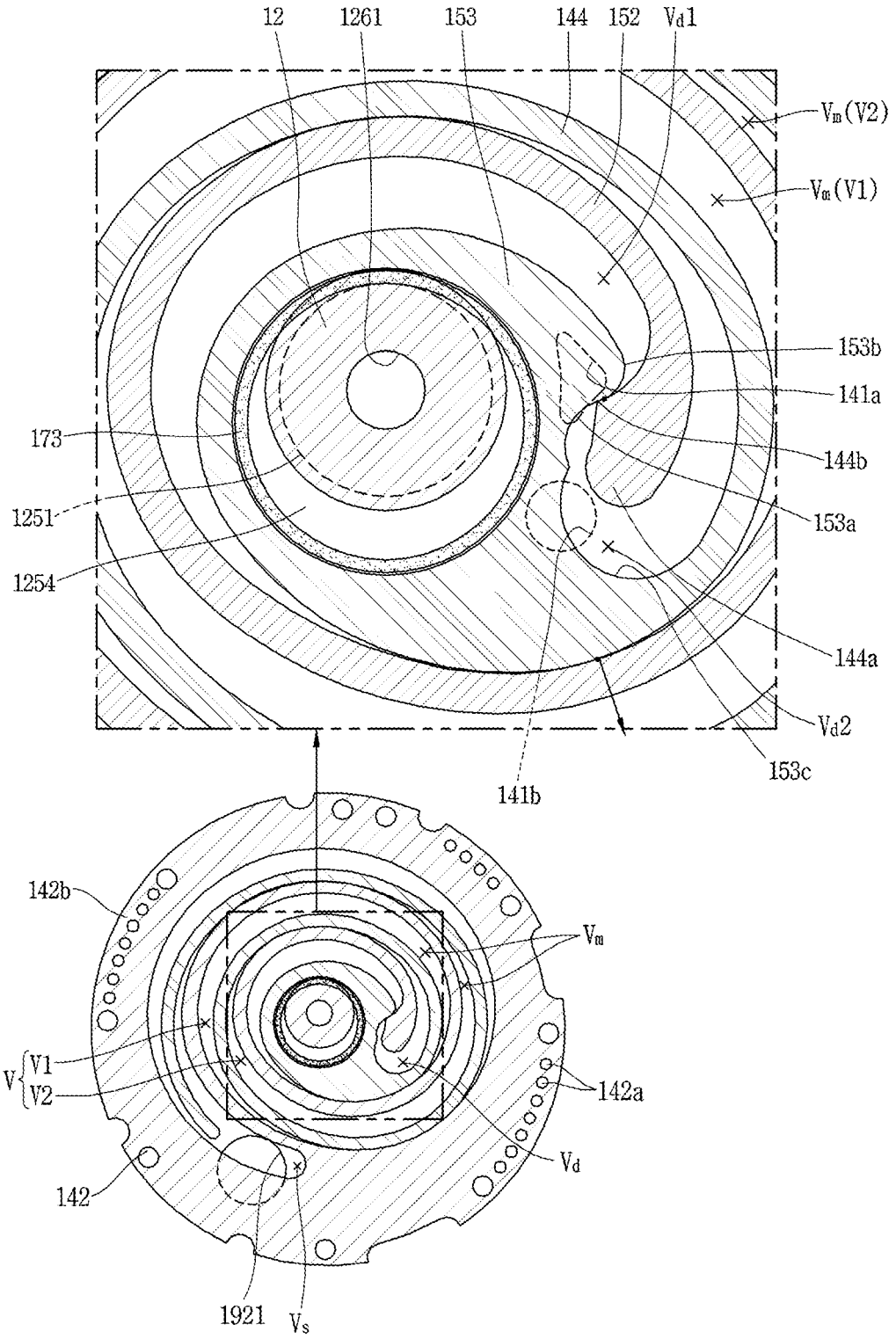
FIG. 4 is a sectional view taken along the line "IV-IV" of FIG. 3.

FIG. 2 is a longitudinal view illustrating a bottom-compression type scroll compressor in accordance with an implementation of the present disclosure, FIG. 3 is an enlarged longitudinal view illustrating a compression unit in in FIG. 2, and FIG. 4 is a sectional view taken along the line "IV-IV" of FIG. 3.

Referring to FIGS. 2-4, in a high-pressure and bottom-compression type scroll compressor (hereinafter, abbreviated as a scroll compressor) according to the implementation of the present disclosure, a driving motor 120 may be installed in an upper half of a casing 110, and a main frame 130, an orbiting scroll 150, a fixed scroll 140, and a discharge cover 160 may be sequentially disposed beneath the driving motor 120. In general, the driving motor 120 may constitute a motor unit, and the main frame 130, the orbiting scroll 150, the fixed scroll 140, and the discharge cover 160 may constitute a compression unit.

The motor unit may be coupled to an upper end of a rotating shaft 125 to be explained later, and the compression unit may be coupled to a lower end of the rotating shaft 125. Accordingly, the compressor 10 may have the bottom-compression type structure described above, and the compression unit may be connected to the motor unit by the rotating shaft 125 to be operated by a rotational force of the motor unit.

Referring to FIG. 2, the casing 110 according to the implementation may include a cylindrical shell 111, an upper shell 112, and a lower shell 113. The cylindrical shell 112 may be formed in a cylindrical shape with upper and lower ends open. The upper shell 112 may be coupled to cover the opened upper end of the cylindrical shell 111. The lower shell 113 may be coupled to cover the opened lower end of the cylindrical shell 111.

Accordingly, the inner space 110*a* of the casing 110 may be sealed. The sealed inner space 110*a* of the casing 110 may be divided into a lower space S1 and an upper space S2 based on the driving motor 120. An oil storage space S3 may be separately defined below the lower space S2 based on the compression unit. The lower space S1 may define a discharge space, and the upper space S2 may define an oil separation space.

The driving motor 120 and the main frame 130 may be fixedly inserted into the cylindrical shell 111. An outer circumferential surface of the driving motor 120 and an outer circumferential surface of the main frame 130 may be spaced apart from an inner circumferential surface of the cylindrical shell 111 by a preset distance, thereby defining an oil recovery passage. This structure will be described in more detail below, together with the oil recovery passage.

A refrigerant suction pipe 115 may be coupled through a side surface of the cylindrical shell 111. Accordingly, the refrigerant suction pipe 115 may be coupled through the cylindrical shell 111 forming the casing 110 in a radial direction.

The refrigerant suction pipe 115 may be formed in an L-like shape. One end of the refrigerant suction pipe 115 may be coupled through the cylindrical shell 111 so as to communicate directly with a first suction passage 1912 of the discharge cover 160 (further described below), which defines a compression unit. In other words, the refrigerant suction pipe 115 may be connected to a suction passage 190 (further described below) at a position lower than a compression chamber V in an axial direction. Accordingly, in this implementation, as the suction passage 190 is formed in the oil storage space S3 which is an empty space below the compression unit, a suction passage opening and closing valve 195 (further described below) may be disposed to operate in the axial direction in a bottom-compression type compressor, without extending a length of the compressor.

Another end of the refrigerant suction pipe 115 may be connected to an accumulator 50 outside the cylindrical shell 111. The accumulator 50 may be connected to an outlet side of the evaporator 40 through a refrigerant pipe. Accordingly, while refrigerant flows from the evaporator 40 to the accumulator 50, liquid refrigerant may be separated in the accumulator 50, and only gaseous refrigerant may be directly introduced into the compression chamber V through the refrigerant suction pipe 115.

A terminal bracket may be coupled to an upper portion of the cylindrical shell 111 or the upper shell 112, and a terminal for transmitting external power to the driving motor 120 may be coupled through the terminal bracket.

A refrigerant discharge pipe 116 may be coupled through an upper portion of the upper shell 112 to communicate with the inner space 110*a* of the casing 110. The refrigerant discharge pipe 116 may correspond to a passage through which compressed refrigerant discharged from the compression unit to the inner space 110*a* of the casing 110 is externally discharged toward the condenser 20.

The refrigerant discharge pipe 116 may be provided therein with an oil separator for separating oil from refrigerant discharged from the compressor 10 to the condenser 20, or a check valve for suppressing refrigerant discharged from the compressor 10 from flowing back into the compressor 10.

Hereinafter, a driving motor constituting the motor unit will be described.

Referring to FIG. 2, the driving motor 120 according to the implementation may include a stator 121 and a rotor 122. The stator 121 may be fixed onto an inner circumferential surface of the cylindrical shell 111, and the rotor 122 may be rotatably disposed in the stator 121.

The stator 121 may include a stator core 1211 and a stator coil 1212.

The stator core 1211 may be formed in a cylindrical shape and may be shrink-fitted onto the inner circumferential surface of the cylindrical shell 111. A plurality of recessed surfaces 1211*a* may be formed in a D-cut shape recessed into an outer circumferential surface of the stator core 1211 along the axial direction, and disposed at preset intervals along a circumferential direction.

The recessed surfaces 1211*a* may be spaced apart from the inner circumferential surface of the cylindrical shell 111 to define a first oil recovery passage through which oil passes. Accordingly, oil separated from refrigerant in the upper space S2 may move to the lower space S1 through the first oil recovery passage, and then may return into the oil storage space S3 through a second oil recovery passage.

The stator coil 1212 may be wound around the stator core 1211 and may be electrically connected to an external power source through a terminal that is coupled through the casing 110. An insulator 1213, which is an insulating member, may be inserted between the stator core 1211 and the stator coil 1212.

The insulator 1213 may extend at both sides in the axial direction to accommodate a bundle of the stator coil 1212 in the radial direction, and a portion of the insulator 1213 which extends downwardly may configure an oil separation portion to restrict refrigerant discharged into the lower space S1 from being mixed with oil recovered from the upper space S2.

The rotor 122 may include a rotor core 1221 and permanent magnets 1222.

The rotor core 1221 may be formed in a cylindrical shape, and may be rotatably inserted into the stator core 1211 with a preset gap therebetween. The permanent magnets 1222 may be embedded in the rotor core 1221 at preset distances along a circumferential direction.

In addition, a balance weight 123 may be coupled to a lower end of the rotor core 1221. Alternatively, the balance weight 123 may be coupled to a shaft portion 1251 of a rotating shaft 125 (further described below).

The rotating shaft 125 may be coupled to the center of the rotor 122. An upper end portion of the rotating shaft 125 may be press-fitted into the rotor 122, and a lower end portion may be rotatably inserted into the main frame 130 to be supported in the radial direction. The main frame 130 may be provided with a main bearing 171 configured as a bush bearing to support the lower end portion of the rotating shaft 125. Accordingly, the rotating shaft 125 may transfer the rotational force of the motor 120 to the orbiting scroll 150 of the compression unit. Accordingly, the orbiting scroll 150 eccentrically coupled to the rotating shaft 125 may perform an orbiting motion with respect to the fixed scroll 140.

Referring to FIG. 2, the rotating shaft 125 may include a shaft portion 1251, a first bearing portion 1252, a second bearing portion 1253, and an eccentric portion 1254.

The shaft portion 1251 may be a portion constituting the upper half of the rotating shaft 125. The shaft portion 1251 may be formed in a solid cylindrical shape, and the rotor 122 may be press-fitted into an upper portion of the shaft portion 1251.

The first bearing portion 1252 may be a portion extending from a lower end of the shaft portion 1251. The first bearing portion 1252 may be inserted into a main bearing hole 133*a* of the main frame 130 (further described below) so as to be supported in the radial direction.

The second bearing portion 1253 may be a portion corresponding to a lower end of the shaft portion 1251. The second bearing portion 1253 may be inserted into a sub bearing hole 143*a* of the fixed scroll 140 (further described below) so as to be supported in the radial direction. The second bearing portion 1253 may be coaxially disposed with respect to the first bearing portion 1252 so as to have the same axial center.

The eccentric portion 1254 may be formed between a lower end of the first bearing portion 1252 and an upper end of the second bearing portion 1253. The eccentric portion 1254 may be inserted into a rotating shaft coupling portion 153 of the orbiting scroll 150 (further described below).

The eccentric portion 1254 may be eccentric with respect to the first bearing portion 1252 or the second bearing portion 1253 in the radial direction. Accordingly, when the rotating shaft 125 rotates, the orbiting scroll 150 may perform an orbiting motion with respect to the fixed scroll 140.

Meanwhile, the rotating shaft 125 may include an oil supply passage 126 formed therein to supply oil to the first bearing portion 1252, the second bearing portion 1252, and the eccentric portion 1254. The oil supply passage 126 may include an inner oil passage 1261 formed in the rotating shaft along the axial direction.

As the compression unit is located below the motor unit 120, the inner oil passage 1261 to may be formed in a grooving manner (e.g., by defining a groove) from the lower end of the rotating shaft 125 approximately to a lower end or a middle height of the stator 121 or up to a position higher than an upper end of the first bearing portion 1252. Of course, according to circumstances, the inner oil passage 1261 may also be formed through the rotating shaft 125 in the axial direction.

In addition, an oil feeder 127 for pumping up oil filled in the oil storage space S3 may be coupled to the lower end of the rotating shaft 125, namely, a lower end of the second bearing portion 1253. The oil feeder 127 may include an oil suction pipe 1271 inserted into the inner oil passage 1261 of the rotating shaft 125, and a blocking member 1272 accommodating the oil suction pipe 1271 to restrict an introduction of foreign materials. The oil suction pipe 1271 may extend downward through the discharge cover 160 to be immersed in the oil filled in the oil storage space S3.

The rotating shaft 125 may be provided with a plurality of oil holes communicating with the inner oil passage 1261 to guide oil moving upward along the inner oil passage 1261 toward the first and second bearing portions 1252 and 1253 and the eccentric portion 1254.

The plurality of oil holes may penetrate from an inner circumferential surface of the inner oil passage 1261 to outer circumferential surfaces of the bearing portions 1252 and 1253 and the eccentric portion 1254. The plurality of oil holes may constitute the oil supply passage 126 together with the inner oil passage 1261, and include a first oil hole 1262*a*, a second oil hole 1262*b*, and a third oil hole 1262*c*.

The first oil hole 1262*a* may be formed from the inner circumferential surface of the inner oil passage 1261 to the outer circumferential surface of the first bearing portion 1252 in a penetrating manner. The second oil hole 1262*b* may be formed from the inner circumferential surface of the inner oil passage 1261 to the outer circumferential surface of the second bearing portion 1253 in a penetrating manner. The third oil hole 1262*c* may be formed from the inner circumferential surface of the inner oil passage 1261 to the outer circumferential surface of the eccentric portion 1254 in a penetrating manner. In other words, the second oil hole 1262*b*, the third oil hole 1262*c*, and the first oil hole 1262*a* may be sequentially formed from the lower end to the upper end of the rotating shaft 125.

In addition, a first oil groove 1263*a* may be formed on the outer circumferential surface of the first bearing portion 1252. The first oil groove 1263*a* may communicate with the inner oil passage 1261 through the first oil hole 1262*a*. A second oil groove 1263*b* may be formed on the second bearing portion 1253 of the rotating shaft 125. The second oil groove 1263*b* may communicate with the inner oil passage 1261 through the second oil hole 1262*b*.

In addition, a third oil groove 1263*c* may be formed on the outer circumferential surface of the eccentric portion 1254. The third oil groove 1263*c* may communicate with the inner oil passage 1261 through the third oil hole 1262*c*. Accordingly, oil, which moves from the inner oil passage 1261 to each of the oil grooves 1263*a*, 1263*b*, and 1263*c* through each of the oil holes 1262*a*, 1262*b*, and 1262*c*, may be evenly spread on the outer circumferential surface of each of the bearing portions 1252 and 1253 and the outer circumferential surface of the eccentric portion 1254, thereby lubricating each bearing surface.

Here, the oil moving to the first oil groove 1263*a* of the first bearing portion 1252 or the oil moving to the third oil groove 1263*c* of the eccentric portion 1254 may flow to an oil accommodating portion 155 (further described below). And, this oil may be supplied to the compression chamber through a compression chamber oil supply hole 156 provided in the orbiting scroll 150 (further described below). The compression chamber oil supply hole will be described in more detail below, together with the orbiting scroll.

Figure 5:
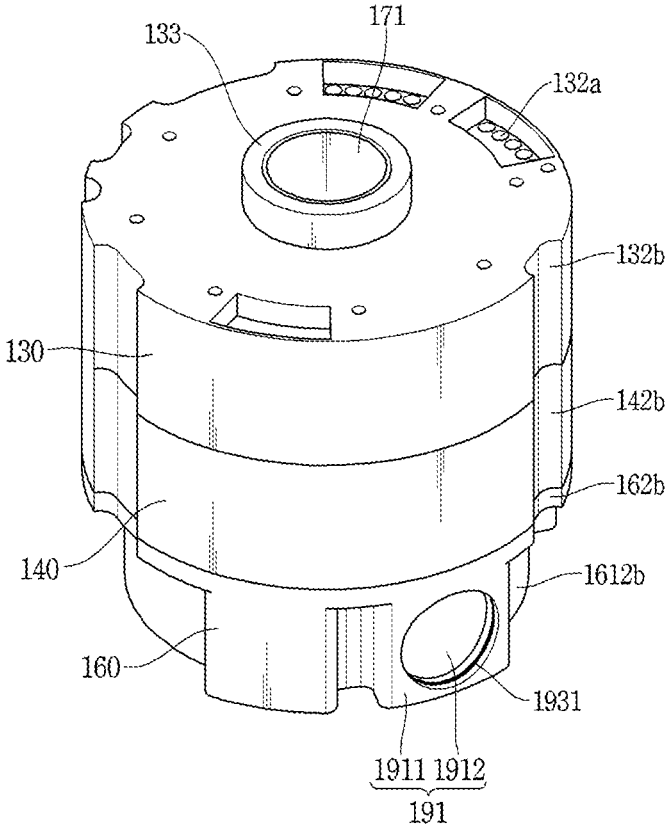
FIG. 5 is a perspective view of a compression unit in an assembled state in accordance with implementations of the present disclosure.

Hereinafter, the compression unit will be described. FIG. 5 is a perspective view of a compression unit in an assembled state in accordance with an implementation of the present disclosure, FIG. 6 is an exploded perspective view of the compression unit according to FIG. 5, viewed from the top, and FIG. 7 is an exploded perspective view of the compression unit according to FIG. 5, viewed from the bottom.

Figure 6:
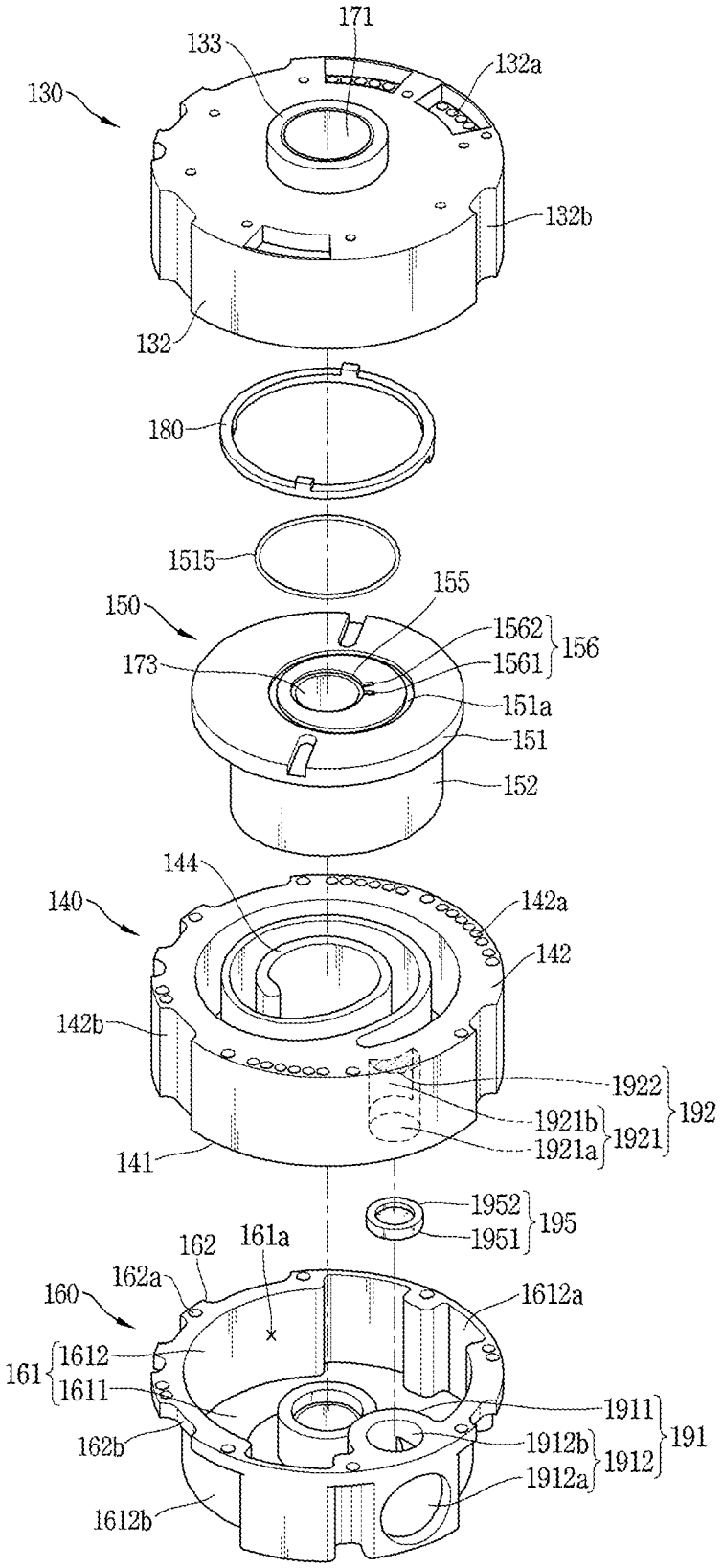
FIG. 6 is a top exploded perspective view of the compression unit according to FIG. 5.
Figure 7:
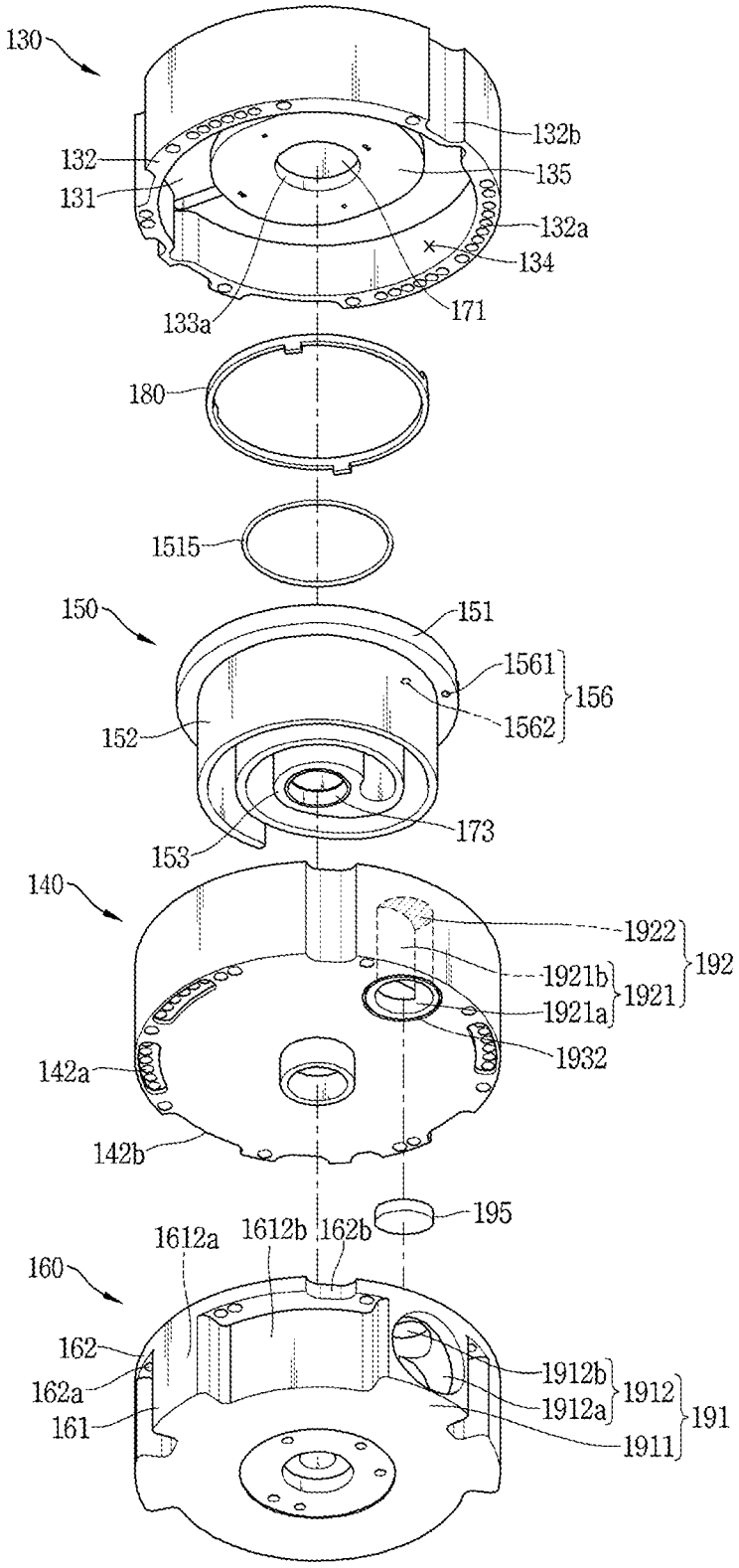
FIG. 7 is a bottom exploded perspective view of the compression unit according to FIG. 5.

Referring to FIGS. 5 to 7, the main frame 130 according to the implementation may include a frame end plate 131, a frame side wall portion 132, a main bearing portion 133, a scroll accommodating portion 134, and a scroll support portion 135.

The frame end plate 131 may be formed in an annular shape and installed below the driving motor 120. Accordingly, the lower space S1 of the casing 110 may be separated from the oil storage space S3 by the frame end plate 131.

The frame side wall portion 132 may extend in a cylindrical shape from an edge of a lower surface of the frame end plate 131. An outer circumferential surface of the frame side wall portion 132 may be fixed to the inner circumferential surface of the cylindrical shell 111 in a shrink-fitting or welding manner.

A scroll accommodating portion 134 (further described below) may formed inside the frame side wall portion 132. The orbiting scroll 150 (further described below) may be accommodated in the scroll accommodating portion 134 so as to perform an orbiting motion. To this end, an inner diameter of the frame side wall portion 132 may be greater than an outer diameter of an orbiting end plate 151 (further described below).

A plurality of frame discharge holes 132*a* may be formed at the frame side wall portion 132. The plurality of frame discharge holes 132*a* may be formed through the frame side wall portion 132 in the axial direction and disposed at preset intervals along a circumferential direction.

The frame discharge holes (hereinafter, referred to as second discharge holes) 132*a* may be formed to correspond to scroll discharge holes 142*a* of the fixed scroll 140 (further described below), and define a first refrigerant discharge passage together with the scroll discharge holes 142*a*.

Also, a plurality of frame oil recovery grooves (hereinafter, referred to as first oil recovery grooves) 132*b* may be formed on an outer circumferential surface of the frame side wall portion 132 with the second discharge holes 132*a* interposed therebetween. The plurality of first oil recovery grooves 132*b* may be formed in the axial direction at preset intervals along the circumferential direction.

The first oil recovery grooves 132*b* may be formed to correspond to the scroll oil recovery groove 142*b* of the fixed scroll 140 (further described below), and define a second oil recovery passage together with the scroll oil recovery grooves 142*b* of the fixed scroll 140.

The main bearing portion 133 may protrude upward from an upper surface of a central portion of the frame end plate 131 toward the driving motor 120. The main bearing portion 133 may be provided with a main bearing hole 133*a* formed therethrough in a cylindrical shape along the axial direction. A main bearing 171 configured as a bush bearing may be firmly fitted onto an inner circumferential surface of the main bearing hole 133*a*. The main bearing portion 133 of the rotating shaft 125 may be fitted onto the main bearing 171 to be supported in the radial direction.

The scroll accommodating portion 134 may be a space defined by a lower surface of the frame end plate 131 and the inner circumferential surface of the frame side wall portion 132. An orbiting end plate 151 of the orbiting scroll 150 (further described below) may be supported in the axial direction by the lower surface of the frame end plate 131, and accommodated in the frame side wall portion 132 in a manner that its outer circumferential surface is spaced apart from the inner circumferential surface of the frame side wall portion 132 by a preset interval (for example, an orbiting radius). Accordingly, the inner diameter of the frame side wall portion 132 constituting the scroll accommodating portion 134 may be greater than the outer diameter of the orbiting end plate 151 by the orbiting radius or more.

In addition, the frame side wall portion 132 defining the scroll accommodating portion 134 may have a height (depth) that is greater than or equal to a thickness of the orbiting end plate 151. Accordingly, while the frame side wall portion 132 is supported on the upper surface of the fixed scroll 140, the orbiting scroll 150 may perform an orbiting motion in the scroll accommodating portion 134.

The scroll support portion 135 may be formed in an annular shape on the lower surface of the frame end plate 131 that faces the orbiting end plate 151 of the orbiting scroll 150 (further described below). Accordingly, an Oldham ring 180 may be pivotably inserted between an outer circumferential surface of the scroll support portion 135 and the inner circumferential surface of the frame side wall portion 132.

In addition, the scroll support portion 135 may have a lower surface formed flat, so that a back pressure sealing member 1515 provided on the orbiting end plate 151 of the orbiting scroll 150 (further described below) is in contact with the lower surface in a sliding manner.

The back pressure sealing member 1515 may be formed in an annular shape, thereby defining an oil accommodating portion 155 between the scroll support portion 135 and the orbiting end plate 151. Accordingly, oil flowing into the oil accommodating portion 155 through the third oil hole 1262*c* of the rotating shaft 125 may be introduced into the compression chamber V through a compression chamber oil supply hole 156 of the orbiting scroll 150 (further described below).

Hereinafter, the fixed scroll will be described.

Referring to FIGS. 5 to 7 again, the fixed scroll 140 according to the implementation may include a fixed end plate 141, a fixed side wall portion 142, a sub bearing portion 143, and a fixed wrap 144.

The fixed end plate 141 may be formed approximately in a disk shape. A sub bearing hole 143*a* forming the sub bearing portion 143 (further described below) may be formed through a center of the fixed end plate 141 in the axial direction. Discharge ports 141*a* and 141*b* may be formed around the sub bearing hole 143*a*. The discharge ports 141*a* and 141*b* may communicate with a discharge chamber Vd so that compressed refrigerant is moved into a discharge space S4 of the discharge cover 160 to be explained later.

Referring also to FIG. 4, only one discharge port may be provided to communicate with both of a first compression chamber V1 and a second compression chamber V2 (further described below). In the illustrated implementation, however, the first discharge port 141*a* may communicate with the first compression chamber V1 and the second discharge port 141*b* may communicate with the second compression chamber V2. Accordingly, refrigerant compressed in the first compression chamber V1 and refrigerant compressed in the second compression chamber V2 may be independently discharged through the different discharge ports.

The fixed side wall portion 142 may extend in an annular shape from an edge of an upper surface of the fixed end plate 141 in the axial direction. The fixed side wall portion 142 may be coupled to face the frame side wall portion 132 of the main frame 130 in the axial direction.

A plurality of scroll discharge holes (hereinafter, referred to as first discharge holes) 142*a* may be formed through the fixed side wall portion 142 in the axial direction and communicate with the frame discharge holes 132*a* to define the first refrigerant discharge passage together with the frame discharge holes 132*a*.

Scroll oil recovery grooves (hereinafter, referred to as second oil recovery grooves) 142*b* may be formed on the outer circumferential surface of the fixed side wall portion 142. The second oil recovery grooves 142*b* may communicate with the first oil recovery grooves 132*b* provided at the main frame 130 to guide oil recovered along the first oil recovery grooves 132*b* to to the oil storage space S3. Accordingly, the first oil recovery grooves 132*b* and the second oil recovery grooves 142*b* may define the second oil recovery passage together with oil recovery grooves 1612*b* and 162*b* of a flange portion 162 (further described below).

Meanwhile, a second suction passage 1921 may be formed in the fixed side wall portion 142 to communicate with a first suction passage 1912 formed in the discharge cover 160 (further described below). The second suction passage 1921 may define a suction port.

The second suction passage 1921 may be formed within a range of a suction chamber Vs (FIG. 4) of the compression unit to communicate with the suction chamber Vs. A suction passage opening and closing valve 195 may be installed in the second suction passage 1921 to selectively open or close a suction passage 190 which includes the second suction passage 1921 and the first suction passage 1912. The suction passage opening and closing valve 195 may also be referred to as a non-return valve, a suction valve, or a check valve.

The suction passage opening and closing valve 195 may be provided at a boundary surface between the first suction passage 1912 and the second suction passage 1921 to allow a fluid movement from the first suction passage 1912 to the second suction passage 1921 while restricting a reverse fluid movement from the second suction passage 1921 to the first suction passage 1912.

Accordingly, during the operation of the compressor, refrigerant suctioned through the refrigerant suction pipe 115 may be introduced into the suction chamber Vs (FIG. 4) through the suction passage 190 including the first suction passage 1912 and the second suction passage 1921. On the other hand, when the compressor is stopped, the suction passage opening and closing valve 195 may close the suction passage 190 so that high-temperature oil contained in the oil storage space of the casing can be prevented from flowing back into the refrigerant suction pipe 115 together with high-temperature refrigerant compressed in the compression chamber. The suction passage including the second suction passage will be described later.

The sub bearing portion 143 may extend in the axial direction from a central portion of the fixed end plate 141 toward the discharge cover 160. The sub bearing portion 143 may be provided with a sub bearing hole 143*a* formed in a cylindrical shape through a center thereof along the axial direction. A sub bearing 172 configured as a bush bearing may be fitted onto an inner circumferential surface of the sub bearing hole 143*a*.

Therefore, the lower end of the rotating shaft 125 may be inserted into the sub bearing portion 143 of the fixed scroll 140 to be supported in the radial direction. The eccentric portion 1254 of the rotating shaft 125 may be supported in the axial direction by the upper surface of the fixed end plate 141 defining the surrounding of the sub bearing portion 143.

A fixed wrap 144 may extend from the upper surface of the fixed end plate 141 toward the orbiting scroll 150 in the axial direction. The fixed wrap 144 may be engaged with an orbiting wrap 152 (further described below) to define the compression chamber V. The fixed wrap 144 will be described later together with the orbiting wrap 152.

Figure 8:
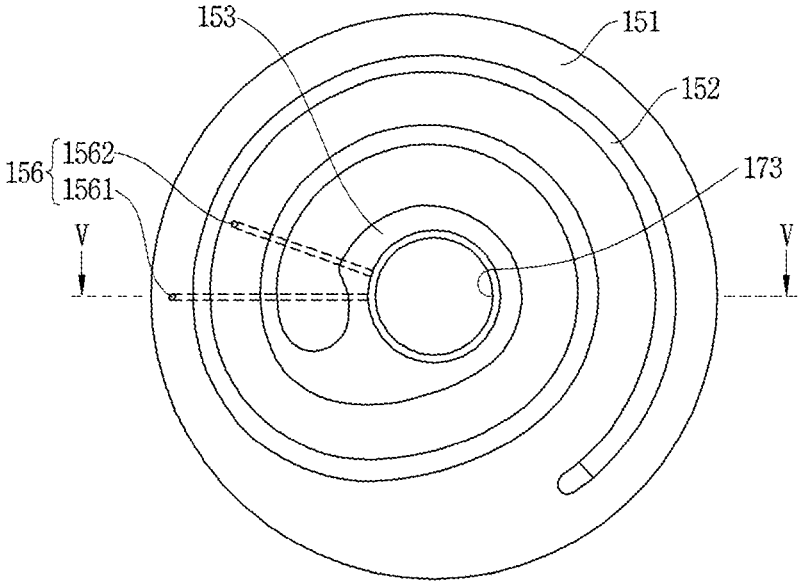
FIG. 8 is a planar view of an orbiting scroll in FIG. 6.

Hereinafter, the orbiting scroll will be described. FIG. 8 is a planar view illustrating the orbiting scroll in FIG. 6, and FIG. 9 is a sectional view taken along the line "V-V" in FIG. 8 to which illustrates a compression chamber oil supply hole of the orbiting scroll.

Figure 9:
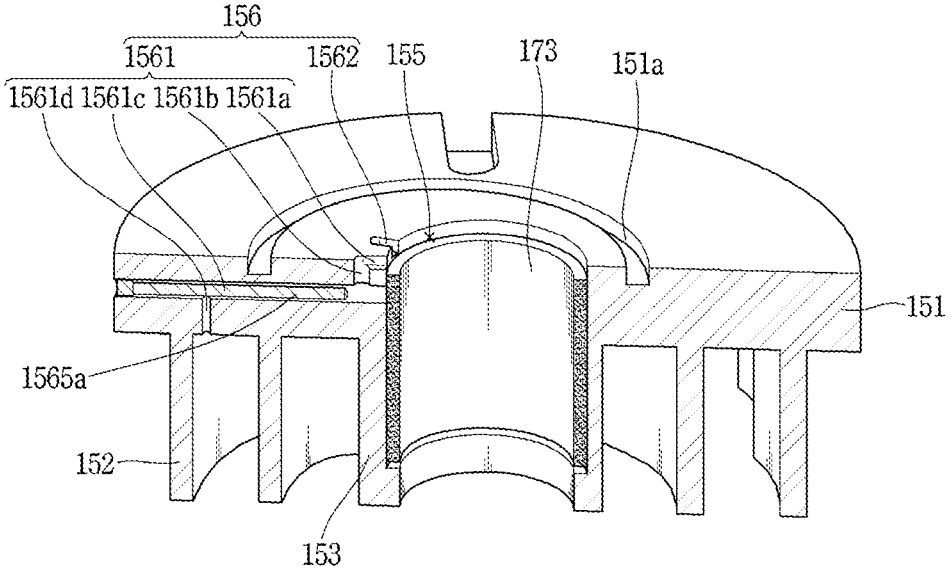
FIG. 9 is a sectional view taken along the line "V-V" in FIG. 8, which illustrates a compression chamber oil supply hole of the orbiting scroll.

Referring to FIGS. 8 and 9, the orbiting scroll 150 according to the implementation may include an orbiting end plate 151, an orbiting wrap 152, and a rotating shaft coupling portion 153.

The orbiting end plate 151 may be formed approximately in a disk shape. A back pressure sealing groove 151*a* into which the back pressure sealing member 1515 is inserted may be formed in an upper surface of the orbiting end plate 151. The back pressure sealing groove 151*a* may be formed at a position facing the scroll support portion 135 of the main frame 130.

The back pressure sealing groove 151*a* may be formed in an annular shape to surround a rotating shaft coupling portion 153 (further described below), and may be eccentric with respect to an axial center of the rotating shaft coupling portion 153. Accordingly, even if the orbiting scroll 150 performs an orbiting motion, a back pressure chamber having a constant range may be defined between the orbiting scroll 150 and the scroll support portion 135 of the main frame 130.

The orbiting end plate 151 may be further provided with a compression chamber oil supply hole 156. One end of the compression chamber oil supply hole 156 may communicate with the oil accommodating portion 155, and another end may communicate with an intermediate pressure chamber of the compression chamber. Accordingly, oil stored in the oil accommodating portion 155 may be supplied to the compression chamber V through the compression chamber oil supply hole 156 to lubricate the compression chamber.

The orbiting wrap 152 may extend from a lower surface of the orbiting end plate 151 toward the fixed scroll 140. The orbiting wrap 152 may be engaged with the fixed wrap 144 to define the compression chamber V.

The orbiting wrap 152 may be formed in an involute shape together with the fixed wrap 144. However, the orbiting wrap 152 and the fixed wrap 144 may be formed in various shapes other than the involute shape. For example, as illustrated in FIG. 4, the orbiting wrap 152 may be formed in a substantially elliptical shape in which a plurality of arcs having different diameters and origins are connected and the outermost curve may have a major axis and a minor axis. The fixed wrap 144 may also be formed in a similar manner.

An inner end portion of the orbiting wrap 152 may be formed at a central portion of the orbiting end plate 151, and the rotating shaft coupling portion 153 may be formed through the central portion of the orbiting end plate 151 in the axial direction.

The eccentric portion 1254 of the rotating shaft 125 may be rotatably inserted into the rotating shaft coupling portion 153. An outer circumferential part of the rotating shaft coupling portion 153 may be connected to the orbiting wrap 152 to form the compression chamber V together with the fixed wrap 144 during a compression process.

The rotating shaft coupling portion 153 may be formed at a height at which it overlaps the orbiting wrap 152 on the same plane. That is, the rotating shaft coupling portion 153 may be disposed at a height at which the eccentric portion 1254 of the rotating shaft 125 overlaps the orbiting wrap 152 on the same plane. Accordingly, repulsive force and compressive force of refrigerant may cancel each other while being applied to the same plane based on the orbiting end plate 151, and thus inclination of the orbiting scroll 150 due to interaction between the compressive force and the repulsive force may be suppressed.

In addition, the rotating shaft coupling portion 153 may be provided with a concave portion 153*a* that is formed on an outer circumferential surface thereof, namely, an outer circumferential surface facing an inner end portion of the fixed wrap 144, to be engaged with a protruding portion 144*a* of the fixed wrap 144 (further described below). A convex portion 153*b* may be formed at one side of the concave portion 153*a*. The convex portion 153*b* may be formed at an upstream side along a direction in which the compression chamber V is formed, and have a thickness increasing from an inner circumferential surface to an outer circumferential surface of the rotating shaft coupling portion 153.

Referring also to FIG. 4, the structures above may extend a compression path of the first compression chamber V1 immediately before discharge, and consequently the compression ratio of the first compression chamber V1 can be increased close to a pressure ratio of the second compression chamber V2. The first compression chamber V1 is a compression chamber formed between an inner surface of the fixed wrap 144 and an outer surface of the orbiting wrap 152. The first compression chamber V1 will be described below in more detail, separately from the second compression chamber V2.

An arcuate compression surface 153*c* having an arcuate shape may be provided at another side of the concave portion 153*a*. The diameter of the arcuate compression surface 153*c* may be determined by a thickness of the inner end portion of the fixed wrap 144 (i.e., a thickness of a discharge end) and an orbiting radius of the orbiting wrap 152.

For example, when the thickness of the inner end portion of the fixed wrap 144 increases, the diameter of the arcuate compression surface 153*c* may increase. As a result, a wrap thickness of the orbiting wrap around the arcuate compression surface 153*c* may increase to ensure durability and thus the compression path may extend to increase the compression ratio of the second compression chamber V2 to that extent.

The protruding portion 144*a* protruding toward the outer circumferential surface of the rotating shaft coupling portion 153 may be formed near the inner end portion (suction end or start end) of the fixed wrap 144 corresponding to the rotating shaft coupling portion 153. Accordingly, a contact portion 144*b* may protrude from the protruding portion 144*a* to be engaged with the concave portion 153*a*.

In other words, the inner end portion of the fixed wrap 144 may be formed to have a larger thickness than other portions. As a result, wrap strength at the inner end portion of the fixed wrap 144, which is subjected to the strongest compressive force on the fixed wrap 144, may increase so as to enhance durability.

On the other hand, the compression chamber V may be formed in a space defined by the fixed end plate 141, the fixed wrap 144, the orbiting end plate 151, and the orbiting wrap 152. The compression chamber V may include a first compression chamber V1 formed between an inner surface of the fixed wrap 144 and an outer surface of the orbiting wrap 152, and a second compression chamber V2 formed between an outer surface of the fixed wrap 144 and an inner surface of the orbiting wrap 152.

In each of the first compression chamber V1 and the second compression chamber V2, a suction chamber Vs, an intermediate pressure chamber Vm, and a discharge chamber Vd may be continuously formed from outside to inside along an advancing direction of the wraps.

Here, the intermediate pressure chamber Vm and the discharge chamber Vd may be independently formed for each of the first compression chamber V1 and the second compression chamber V2. Accordingly, the first discharge port 141*a* may communicate with a discharge chamber Vd1 of the first compression chamber V1 and the second discharge port 141*b* may communicate with a discharge chamber Vd2 of the second compression chamber V2.

On the other hand, the suction chamber Vs may be formed to be shared by the first compression chamber V1 and the second compression chamber V2. That is, the suction chamber Vs may be formed at an outer side than the orbiting wrap 152 based on the advancing direction of the wrap. Specifically, the suction chamber Vs may be defined as a space formed in an area that the end of the orbiting wrap 152 does not reach, namely, outside an orbiting range of the orbiting wrap 152, in a space formed between the inner circumferential surface of the fixed side wall portion 142 and an outer surface of the outermost fixed wrap 144 extending from the fixed side wall portion 142.

Accordingly, the second suction passage 1921 may be formed through the fixed end plate 141 in the axial direction to communicate with the suction chamber Vs, and the suction passage opening and closing valve 195 may not interfere with the orbiting wrap 152 even though it passes through the suction chamber Vs while moving in the second suction passage 1921 in the axial direction along the fixed side wall portion 142. This will be described in more detail below, together with the suction passage and the suction passage opening and closing valve.

On the other hand, an eccentric portion bearing 173 configured as a bush bearing may be fitted onto the inner circumferential surface of the rotating shaft coupling portion 153. The eccentric portion 1254 of the rotating shaft 125 may be rotatably inserted into the eccentric portion bearing 173. Accordingly, the eccentric portion 1254 of the rotating shaft 125 may be supported by the eccentric portion bearing 173 in the radial direction so as to perform a smooth orbiting motion with respect to the orbiting scroll 150.

Here, the oil accommodating portion 155 may be formed inside the rotating shaft coupling portion 153. The oil accommodating portion 155 may communicate with the compression chamber oil supply hole 156 that is formed through the orbiting end plate 151 in the radial direction.

The oil accommodating portion 155 may be formed on the upper side of the eccentric portion bearing 173. For example, an axial length of the eccentric portion bearing 173 may be shorter than an axial length (height) of the rotating shaft coupling portion 153. Accordingly, a space corresponding to a difference in length between the eccentric portion bearing 173 and the rotating shaft coupling portion 153 and the thickness of the eccentric portion bearing 173 may be formed in an upper end of the eccentric portion bearing 173. This space may communicate with the third oil hole 1262*c* or the first oil hole 1262*a* of the rotating shaft 125 to define the aforementioned oil accommodating portion 155.

Alternatively, only one compression chamber oil supply hole 156 may be provided to communicate with any one of the first compression chamber V1 and the second compression chamber V2. However, in the illustrated implementation, the compression chamber oil supply hole 156 may include a first compression chamber oil supply hole 1561 communicating with the first compression chamber V1, and a second compression chamber oil supply hole 1562 communicating with the second compression chamber V2.

For example, one end, namely, an inlet of the first compression chamber oil supply hole 1561 and one end, namely, an inlet of the second compression chamber oil supply hole 1562 may communicate with the oil accommodating portion 155, respectively. In addition, another end, namely, an outlet of the first compression chamber oil supply hole 1561 and another end, namely, an outlet of the second compression chamber oil supply hole 1562 may communicate with the first compression chamber V1 and the second compression chamber V2, respectively.

Specifically, the outlets of the first compression chamber oil supply hole 1561 and the second compression chamber oil supply hole 1562 may penetrate through the lower surface of the orbiting end plate 151 at a time point when suction in each compression chamber V1 and V2 is completed, namely, at a rotating angle of the orbiting wrap 152 greater than a rotating angle of the orbiting wrap 152, at which the suction in each compression chamber V1 and V2 is completed.

Accordingly, the outlets of the first compression chamber oil supply hole 1561 and the second compression chamber oil supply hole 1562 may be located at a more downstream side than the suction passage opening and closing valve 195 based on a direction that the refrigerant is suctioned. Accordingly, when the compressor is stopped, oil which is intended to flow back toward the refrigerant suction pipe 115 through the first compression chamber oil supply hole 1561 and the second compression chamber oil supply hole 1562 may be restricted by the suction passage opening and closing valve 195, thereby preventing oil leakage from the compression chambers V1 and V2 toward the refrigerant suction pipe 115.

The first compression chamber oil supply hole 1561 and the second compression chamber oil supply hole 1562 may have the same basic configuration, except for the positions where the ends of those holes communicate with the first compression chamber V1 and the second compression chamber V2, respectively. Therefore, hereinafter, the first compression chamber oil supply hole 1561 will be mainly described, and the second compression chamber oil supply hole 1562 will be understood similarly based on the description of the first compression chamber oil supply hole 1561.

The first compression chamber oil supply hole 1561 may include an oil supply inlet portion 1561*a*, an oil supply connection portion 1561*b*, an oil supply penetration portion 1561*c*, and an oil supply outlet portion 1561*d*. The oil supply inlet portion 1561*a* may have an inlet end communicating with the oil accommodating portion 155 to define the inlet of the first compression chamber oil supply hole 1561. The oil supply outlet portion 1561*d* may have an outlet end communicating with the first compression chamber V1 to define the outlet of the first compression chamber oil supply hole 1561.

Accordingly, oil inside the oil accommodating portion 155 may be supplied to the first compression chamber V1 sequentially through the oil supply inlet portion 1561*a*, the oil supply connection portion 1561*b*, the oil supply penetration portion 1561*c*, and the oil supply outlet portion 1257*d*.

Specifically, the oil supply inlet portion 1561*a* may extend radially from the upper surface of the orbiting end plate 151, and the oil supply connection portion 1561*b* may be formed in a penetrating manner in the axial direction from an end of the oil supply inlet portion 1561*a* to the oil supply penetration portion 1561*c*. The oil supply penetration portion 1561*c* may radially penetrate through the inside of the orbiting end plate, and the oil supply outlet portion 1561*d* may penetrate through the lower surface of the orbiting end plate 151 at an end of the oil supply penetration portion 1561*c* in the radial direction. Accordingly, the first compression chamber oil supply hole 1561 may allow the communication between the oil accommodating portion 155 and the first compression chamber V1.

In addition, the oil supply inlet portion 1561*a* may extend toward a side to which the back pressure sealing groove 151*a* is eccentric from the rotating shaft coupling portion 153 at an inner side than the back pressure sealing groove 151*a*. However, considering the fact that a first pressure reducing member 1565*a* is installed inside the oil supply penetration portion 1561*c*, a length of the oil supply inlet portion 1561*a* may preferably be as short as possible.

In addition, the oil supply inlet portion 1561*a* may communicate with the oil accommodating portion 155 and may be recessed into the upper surface of the orbiting end plate 151 by a preset depth. Accordingly, oil contained in the oil accommodating portion 155 may move to the oil supply inlet portion 1561*a* and spread to the upper surface of the orbiting scroll 150 at an inner side of the back pressure sealing member 1515, thereby smoothly lubricating a gap between the main frame 130 and the orbiting scroll 150.

In addition, the first pressure reducing member 1565*a* may be inserted into the oil supply penetration portion 1561*c*. The first pressure reducing member 1565*a* may be configured as a pressure reducing pin having an outer diameter smaller than an inner diameter of the oil supply penetration portion 1561*c*. Accordingly, oil in the oil accommodating portion 155 may be decompressed while passing through the first pressure reducing member 1565*a* inside the oil supply penetration portion 1561*c* and supplied to the first compression chamber V1 (FIG. 4).

In addition, the oil supply outlet portion 1561*d* may be formed at a position spaced apart from an outer surface of the outermost orbiting wrap 152 by a preset interval. For example, the oil supply outlet portion 1561*d* may be formed at a position where the first compression chamber oil supply hole 1561 communicates with the first compression chamber V1 (FIG. 4) and the second compression chamber oil supply hole 1562 communicates with the second compression chamber V2 (FIG. 4), independently, regardless of an orbiting position (crank angle) of the orbiting scroll 150.

Specifically, the oil supply outlet portion 1561*d* may be formed at a position spaced apart from the outer surface of the outermost orbiting wrap 152 by more than a value that is obtained by subtracting the inner diameter of the oil supply outlet portion 1561*d* from a wrap thickness on a line in the radial direction of the first compression chamber oil supply hole 1561. In this case, the oil supply outlet portion 1561*d* of the second compression chamber oil supply hole 1562 provided at the inner side of the outermost orbiting wrap 152 may also be formed at the same position.

Accordingly, even when the plurality of compression chamber oil supply holes 156 is formed, the first compression chamber oil supply hole 1561 may communicate almost only with the first compression chamber V1, and the second compression chamber oil supply hole 1562 may communicate almost only with the second compression chamber V2.

This may present the first compression chamber V1 and the second compression chamber V2 from communicating with each other through the first compression chamber oil supply hole 1561, the second compression chamber oil supply hole 1562, and the oil accommodating portion 155, at an entire orbiting position of the orbiting scroll 150.

This may also prevent oil from flowing backward from a relatively high-pressure compression chamber to a relatively low-pressure compression chamber due to a pressure difference between the both compression chambers V1 and V2 (FIG. 4) in a specific orbiting section through the both oil supply holes 1561 and 1562. Accordingly, a constant amount of oil may be almost always supplied to the both compression chambers, which may result in improving reliability of the compressor 10, reducing friction loss, and enhancing compressor performance.

In some cases, when only one compression chamber oil supply hole 156 is provided, the oil supply outlet portion defining the outlet of the compression chamber oil supply hole 156 may be formed at a position where it alternately communicates with the first compression chamber or the second compression chamber depending on a rotating angle of the orbiting scroll 150 during the orbiting motion of the orbiting scroll 150.

Hereinafter, the discharge cover will be described.

Referring back to FIGS. 5 to 7, the discharge cover 160 may include a cover housing portion 161 and a cover flange portion 162. The cover housing portion 161 may have a cover space 161*a* therein defining the discharge space S4 together with the fixed scroll 140.

The cover housing portion 161 may include a housing bottom surface 1611 and a housing side wall surface 1612 extending in the axial direction from the housing bottom surface 1611 to have a substantially annular shape.

Accordingly, the housing bottom surface 1611 and the housing side wall surface 1612 may define the cover space 161*a* for accommodating the outlets of the discharge ports 141*a* and 141*b* provided in the fixed scroll 140 and the inlet of the first discharge hole 142*a*. The cover space 161*a* may define the discharge space S4 together with a surface of the fixed scroll 140 inserted into the cover space 161*a*.

A cover bearing protrusion 1613 may protrude from a central portion of the housing bottom surface 1611 toward the fixed scroll 140 in the axial direction, and a through hole 1613*a* may be formed through the inside of the cover bearing protrusion 1613 in the axial direction.

The sub bearing portion 143 that protrudes from the rear surface of the fixed scroll 140, namely, the fixed end plate 141 in a downward direction (axial direction) may be inserted into the through hole 1613*a*. A cover sealing member 1614 for sealing a gap between an inner circumferential surface of the through hole 1613*a* and an outer circumferential surface of the sub bearing portion 143 may be inserted into the gap.

The housing side wall surface 1612 may extend outward from an outer circumferential surface of the cover housing portion 161 so as to be coupled in close contact with the lower surface of the fixed scroll 140. In addition, at least one discharge guide groove 1612*a* may be formed on an inner circumferential surface of the housing side wall surface 1612 along the circumferential direction.

The discharge guide groove 1612*a* may be recessed outward in the radial direction, and the first discharge hole 142*a* of the fixed scroll 140 defining a first refrigerant discharge passage may be formed to be positioned inside the discharge guide groove 1612*a*. Accordingly, an inner surface of the housing side wall surface 1612 excluding the discharge guide groove 1612*a* may be brought into close contact with the outer circumferential surface of the fixed scroll 140, namely, the outer circumferential surface of the fixed end plate 141 so as to configure a type of sealing part.

Here, an entire circumferential angle of the discharge guide groove 1612*a* may be formed to be smaller than or equal to an entire circumferential angle with respect to an inner circumferential surface of the discharge space S4 except for the discharge guide groove 1612*a*. In this manner, the inner circumferential surface of the discharge space S4 except for the discharge guide groove 1612*a* can secure not only a sufficient sealing area but also a circumferential length for forming the cover flange portion 162 (further described below).

The housing side wall surface 1612 may be provided with oil recovery grooves 1612*b* formed on an outer circumferential surface thereof with a preset interval along the circumferential direction so as to define a third oil recovery groove. For example, the oil recovery groove 1612*b* may be formed on the outer circumferential surface of the housing side wall surface 1612. The oil recovery groove 1612*b* may define the third oil recovery groove together with oil recovery grooves 162*b* of the cover flange portion 162 (further described below). The third oil recovery groove of the discharge cover 160 may define the second oil recovery passage together with the first oil recovery groove of the main frame 130 and the second oil recovery groove of the fixed scroll 140.

The cover flange portion 162 may extend radially from a portion defining the sealing part, namely, from an outer circumferential surface of a portion, excluding the discharge guide groove 1612*a*, of the housing side wall surface 1612 of the cover housing portion 161.

The cover flange portion 162 may be provided with coupling holes 162*a* for coupling the discharge cover 160 to the fixed scroll 140 with bolts, and a plurality of oil recovery grooves 162*b* formed between the neighboring coupling holes 162*a* at preset intervals in the circumferential direction.

The oil recovery grooves 162*b* formed on the cover flange portion 162 may define the third oil recovery groove together with the oil recovery groove 1612*b* formed on the housing side wall surface 1612. The oil recovery grooves 162*b* formed on the cover flange portion 162 may be recessed inward (toward a center) in the radial direction from an outer circumferential surface of the cover flange portion 162.

Meanwhile, the first suction passage 1912 may be formed in the discharge cover 160, and the refrigerant suction pipe 115 may communicate with the second suction passage 1921 of the fixed scroll 140 through the first suction passage 1912. The refrigerant suction pipe 115 inserted through the cylindrical shell 111 may be inserted into an inlet of the first suction passage 1912 so as to communicate directly with the first suction passage 1912. An outlet of the first suction passage 1912 may communicate with the second suction passage 1921 of the fixed scroll 140. In addition, the outlet of the first suction passage 1912 may be selectively opened and closed by the suction passage opening and closing valve 195 inserted into the second suction passage 1921.

Accordingly, refrigerant circulating in the refrigeration cycle during the operation of the compressor may flow into the first suction passage 1912 of the discharge cover 160 through the refrigerant suction pipe 115. The refrigerant may open the suction passage opening and closing valve 195 so as to be introduced into the suction chamber Vs (FIG. 4) through the second suction passage 1921.

Referring to FIG. 1, the refrigeration cycle system further includes a condenser fan 21 and an evaporator fan 41.

Hereinafter, referring to FIGS. 1-4, an operation of the high-pressure and bottom-compression type scroll compressor according to the implementation will be described.

That is, when power is applied to the motor 120, rotational force may be generated and the rotor 122 and the rotating shaft 125 may rotate accordingly. As the rotating shaft 125 rotates, the orbiting scroll 35 eccentrically coupled to the rotating shaft 125 may perform an orbiting motion by the Oldham ring 180.

Accordingly, the volume of the compression chamber V may gradually decrease from a suction chamber Vs formed at an outer side of the compression chamber V toward an intermediate pressure chamber Vm continuously formed toward a center and a discharge chamber Vd in a central portion.

Then, refrigerant may move to the accumulator 50 sequentially via the condenser 20, the expansion apparatus 30, and the evaporator 40 of the refrigeration cycle. The refrigerant may flow toward the suction chamber Vs forming the compression chamber V through the refrigerant suction pipe 115.

The refrigerant suctioned into the suction chamber Vs may be compressed while moving to the discharge chamber Vd via the intermediate pressure chamber Vm along a movement trajectory of the compression chamber V. The compressed refrigerant may be discharged from the discharge chamber Vd to the discharge space S4 of the discharge cover 60 through the discharge ports 141*a* and 141*b*.

The refrigerant discharged into the discharge space S4 of the discharge cover 160 may then flow into the inner space 110*a* of the casing 110 through the discharge guide groove 1612*a* of the discharge cover 160 and the first discharge holes 142*a* of the fixed scroll 140. The refrigerant may flow to the lower space S1 between the main frame 130 and the driving motor 120 and then move toward the upper space S2 of the casing 110, which is defined above the driving motor 120, through a gap between the stator 121 and the rotor 122.

However, oil may be separated from the refrigerant in the upper space S2 of the casing 110, and the oil-separated refrigerant may be discharged to the outside of the casing 110 through the refrigerant discharge pipe 116 so as to flow to the condenser 20 of the refrigeration cycle.

On the other hand, the oil separated from the refrigerant in the inner space 110*a* of the casing 110 may be recovered into the oil storage space S3 defined in the lower portion of the compression unit through the first oil recovery passage between the inner circumferential surface of the casing 110 and the stator 121 and the second oil recovery passage between the inner circumferential surface of the casing 110 and the outer circumferential surface of the compression unit. Thus, this oil may be supplied to each bearing surface through the oil supply passage 126, and partially supplied into the compression chamber V. The oil supplied to the bearing surface and the compression chamber V may be discharged to the discharge cover 160 together with the refrigerant and recovered. This series of processes may be repeatedly performed.

On the other hand, when the compressor 10 is stopped, the refrigeration cycle including the compressor 10 may perform an operation to enter a so-called pressure equilibrium state. For example, immediately after the compressor 10 is stopped, the interior of the compressor 10 may be divided into a high-pressure region and a low-pressure region based on the compression chamber. That is, while the inner space 110*a* of the casing 110 is still maintained in a discharge pressure state, a suction pressure state may be maintained around the outlet side of the refrigerant suction pipe 115.

At this time, in the high-pressure scroll compressor in which the refrigerant suction pipe 115 directly communicates with the compression chamber V, oil or refrigerant filled in the inner space 110*a* of the casing 110 may flow back toward the refrigerant suction pipe 115 while the pressure equalization operation is in progress in the stopped state of the compressor. The back flow of the oil or refrigerant occurs much more prominently in the bottom-compression type scroll compressor in which the compression unit is disposed below the driving motor 120 to be adjacent to the oil storage space S3.

As described above, when oil or refrigerant remaining in the inner space 110*a* of the casing 110 leaks due to flowing back toward the refrigerant suction pipe 115, high-temperature refrigerant or oil may be mixed with refrigerant to be suctioned and thereby a specific volume of suction refrigerant may be increased. This may cause an increase in suction loss. In addition, when the refrigeration cycle is restarted, an oil shortage may occur inside the compressor. This may cause reliability and performance of the compressor to be deteriorated due to friction.

Accordingly, in this implementation, since the suction passage opening and closing valve as a kind of check valve is installed in the middle of the suction passage, even if the pressure equalization operation is performed inside the casing in the stopped state of the compressor, oil or refrigerant inside the casing may be suppressed from flowing back toward the suction passage through the compression unit.

In particular, as the non-return valve is installed inside the compression unit provided in the inner space of the casing, the oil or refrigerant that flows backward can be blocked inside the compression unit, which may prevent refrigerant suctioned upon the restart of the compressor from being heated, thereby reducing the suction loss. In addition, oil leakage to the outside of the compressor can be minimized, which may result in reducing frictional loss due to an oil shortage upon the restart of the compressor.

Figure 10:
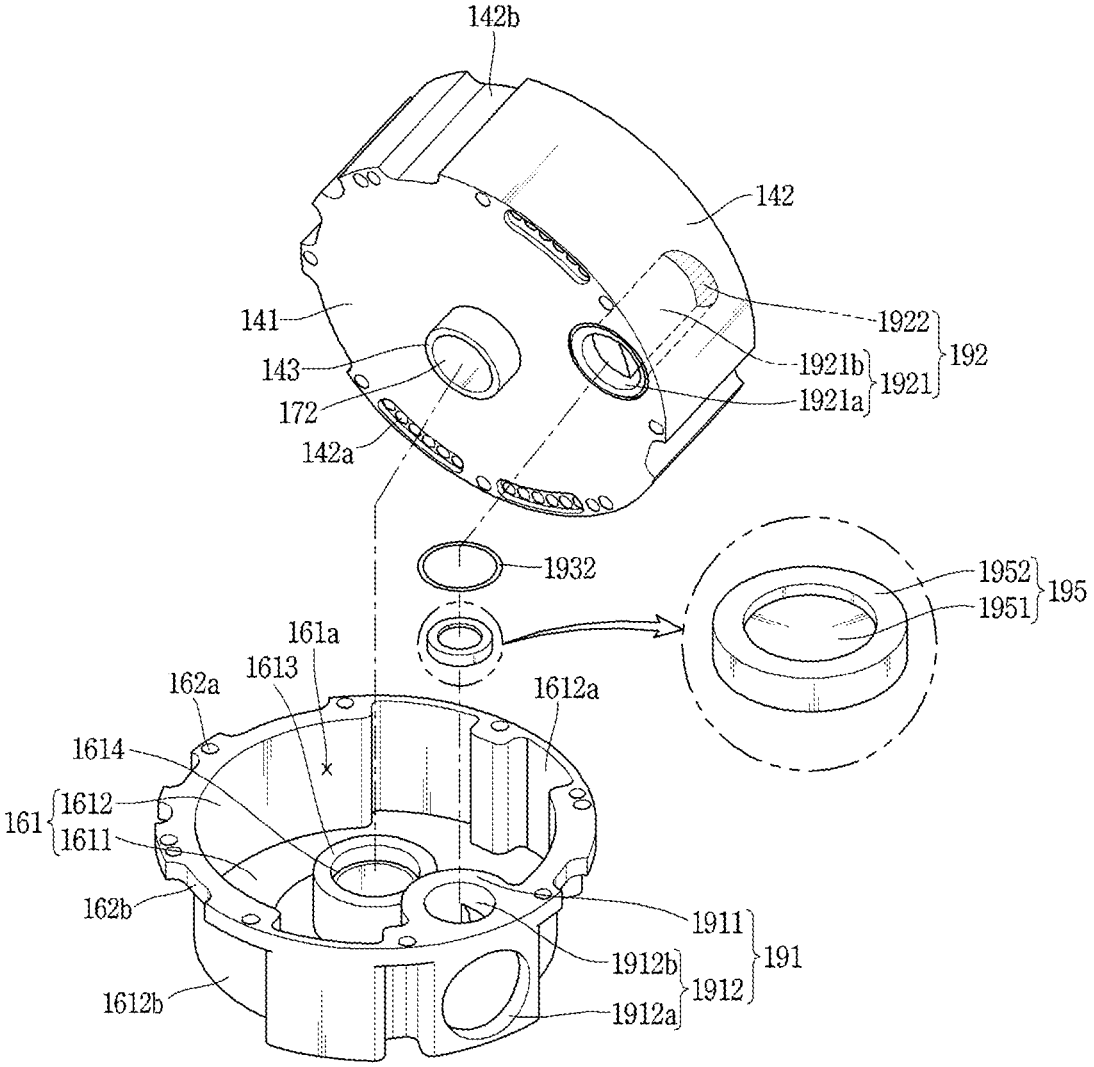
FIG. 10 is an exploded perspective view of a fixed scroll and a discharge cover in FIG. 6.
Figure 11:
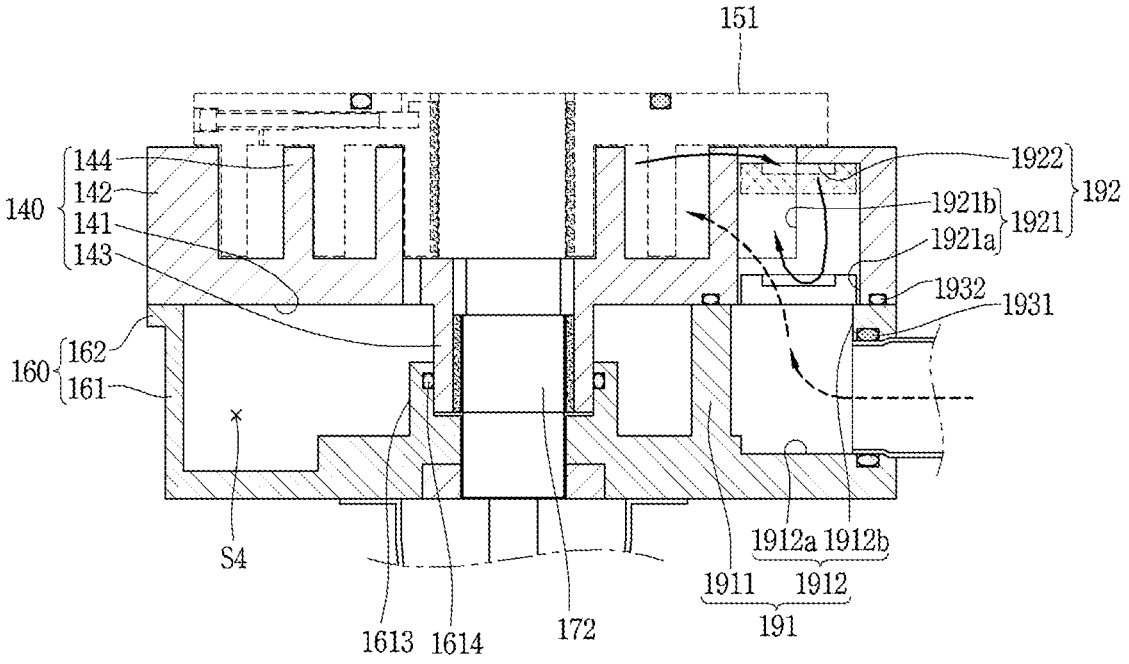
FIG. 11 is a sectional view of the fixed scroll and the discharge cover of FIG. 10 in an assembled state.
Figure 12A:
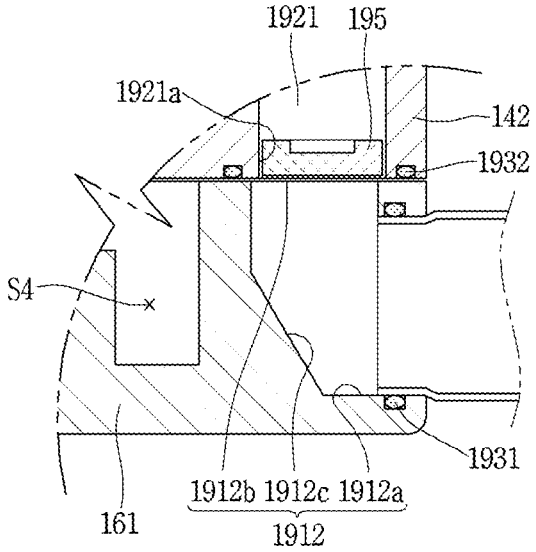
FIGS. 12A and 12B are sectional views illustrating other implementations of a suction passage.
Figure 12B:
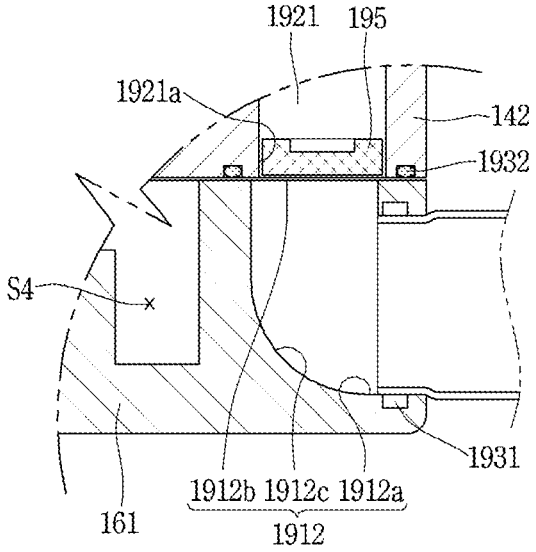
Figure 13:
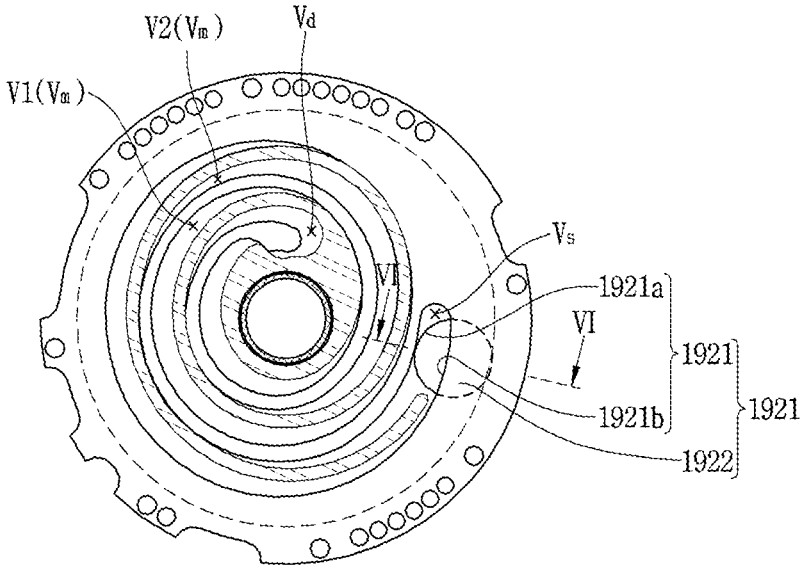
FIG. 13 is a top planar view of the fixed scroll in FIG. 11.
Figure 14:
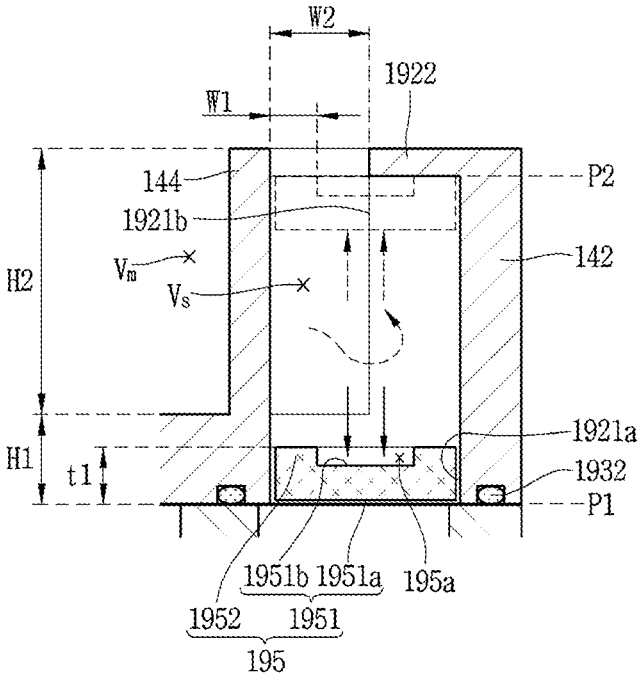
FIG. 14 is a sectional view taken along the line "VI-VI" of FIG. 13.

FIG. 10 is an exploded perspective view of the fixed scroll and the discharge cover in FIG. 6, FIG. 11 is a sectional view of the fixed scroll and the discharge cover of FIG. 10 in an assembled state, FIGS. 12A and 12B are sectional views illustrating other implementations of a first suction passage, FIG. 13 is a top planar view of the fixed scroll in FIG. 11, from the top, and FIG. 14 is a sectional view taken along the line "VI-VI" of FIG. 13.

Referring back to FIGS. 2 and 3, the scroll compressor according to the implementation may include the suction passage opening and closing valve 195 installed in the inner space 110*a* of the casing 110, more precisely, in the suction passage 190 for connecting the refrigerant suction pipe 115 and the compression chamber V. Accordingly, when the compressor is stopped, oil or refrigerant flowing backward from the compression chamber V toward the refrigerant suction pipe 115 can be blocked inside the casing 110, that is, before reaching the refrigerant suction pipe 115.

The suction passage 190 according to the implementation may include a first suction passage portion 191 provided in the discharge cover 160 and a second suction passage portion 192 provided in the fixed scroll 140. The first suction passage portion 191 and the second suction passage portion 192 may communicate with each other. An inlet of the first suction passage portion 191 may communicate with the refrigerant suction pipe 115, and an outlet of the second suction passage portion 192 may communicate with the suction chamber Vs forming the compression chamber V.

Referring to FIGS. 10 and 11, the first suction passage portion 191 according to the implementation may include a suction guide protrusion 1911 and a first suction passage 1912 formed through the inside of the suction guide protrusion 1911. The suction guide protrusion 1911 may integrally extend from the discharge cover 160, and the first suction passage 1912 may be formed through the discharge cover 160.

The suction guide protrusion 1911 may extend integrally from the housing bottom surface 1611 and the inner circumferential surface of the housing side wall surface 1612 of the cover housing portion 161 forming the discharge cover 160. For example, the suction guide protrusion 1911 may protrude from the inner circumferential surface of the housing side wall surface 1612 toward the central portion of the cover housing portion 161, that is, toward the central portion of the cover space 161*a* forming the discharge space S4. Accordingly, a height of the suction guide protrusion 1911 in the axial direction may be the same as a height of the housing side wall surface 1612.

In addition, the outer circumferential surface of the suction guide protrusion 1911 may be coupled to be almost brought into contact with the inner circumferential surface of the cylindrical shell 111 forming the casing 110, and the upper surface of the suction guide protrusion 1911 may be coupled to be brought into close contact with the lower surface of the fixed end plate 141.

In addition, the first suction passage 1912, which will be described further below, may be formed between the outer circumferential surface and the upper surface of the suction guide protrusion 1911 in a penetrating manner. Accordingly, a suction passage sealing member may be provided respectively between an outer circumferential surface of the suction guide protrusion 1911 forming an inlet 1912*a* of the first suction passage 1912 and the inner circumferential surface of the cylindrical shell 111 facing the outer circumferential surface, and between the upper surface of the suction guide protrusion 1911 forming an outlet 1912*b* of the first suction passage 1912 and the lower surface of the fixed end plate 141 facing the upper surface.

For example, a suction passage sealing member (hereinafter, referred to as a first suction passage sealing member) 1931 may be provided in the inlet 1912*a* of the first suction passage 1912 to seal a gap between the inner circumferential surface of the first suction passage 1912 and the outer circumferential surface of the refrigerant suction pipe 115 (in particular, a connection pipe).

The first suction passage sealing member 1931 may be formed in an annular shape like an O-ring, and may be fitted onto the inner circumferential surface of the inlet 1912*a* of the first suction passage 1912. This may result in restricting leakage of refrigerant between the inner circumferential surface of the first suction passage 1912 and the outer circumferential surface of the refrigerant suction pipe 115.

The outlet 1912*b* of the first suction passage 1912 may communicate with an inlet 1921*a* of the second suction passage 1921 (further explained below) as the upper surface of the suction guide protrusion 1911 is in contact with the lower surface of the fixed end plate 141. Accordingly, a suction passage sealing member (hereinafter, referred to as a second suction passage sealing member) 1932 may be disposed between the upper surface of the suction guide protrusion 1911 and the lower surface of the fixed end plate 141 to seal a gap between the first suction passage 1912 and the second suction passage 1921. The second suction passage sealing member will be described in more detail below, together with a valve seat surface.

Referring to FIG. 11, the first suction passage 1912 according to the implementation may be formed through the inside of the suction guide protrusion 1911. As described above, one end of the first suction passage 1912 may be formed in the radial direction to penetrate through the outer circumferential surface of the suction guide protrusion 1911 which extends from the housing side wall surface 1612, and another end of the first suction passage 1912 may be formed in the axial direction through the upper surface of the suction guide protrusion 1911.

Accordingly, the first suction passage 1912 may be formed in a cross-sectional shape like "L" when viewed from the front. The first suction passage 1912 will be described, provided that one side connected to the refrigerant suction pipe 115 is defined as the inlet 1912*a* and another side connected to the second suction passage 1921 is defined as the outlet 1912*b*.

The inlet 1912*a* and the outlet 1912*b* of the first suction passage 1912 may be formed in a circular cross-sectional shape having substantially the same inner diameter. However, when the refrigerant suction pipe 115 is inserted into the inlet 1912*a* of the first suction passage 1912, the outlet 1912*b* of the first suction passage 1912 may be formed to have substantially the same inner diameter as that of the refrigerant suction pipe 115. Accordingly, flow resistance against refrigerant suctioned through the refrigerant suction pipe 115 can be minimized.

In addition, the inner circumferential surface of the first suction passage between the inlet 1912*a* and the outlet 1912*b* may be bent at a right angle as shown in FIG. 11. In this case, a wide volume of the first suction passage 1912 may be secured to increase a suction flow rate of refrigerant.

However, the first suction passage 1912 may be provided with an inclined suction guide surface 1912*c* as illustrated in FIG. 12A or a curved suction guide surface 1912*c* as illustrated in FIG. 12B, which is formed at the inner circumferential surface between the inlet 1912*a* and the outlet 1912*b*, in particular, a surface facing an end of the refrigerant suction pipe 115 in the radial direction.

In this case, refrigerant can smoothly flow from the inlet 1912*a* of the outlet 1912*b* of the first suction passage 1912 along the suction guide surface 1912*c*. This may prevent refrigerant vortex from being formed between the inlet 1912*a* and the outlet 1912*b* of the first suction passage 1912, thereby securing the thickness of the discharge cover 160 and minimizing suction loss of refrigerant.

On the other hand, referring to FIGS. 10 and 11, the second suction passage portion 192 according to the implementation may include a second suction passage 1921 and a valve stopper 1922 for partially covering an upper end of the second suction passage 1921 in the axial direction. The second suction passage portion 192 may define the suction passage 190 together with the suction guide protrusion 1911 of the discharge cover 160.

The second suction passage 1921 may be formed by recessing the lower surface of the fixed end plate 141 by a preset depth (or height) in the axial direction. The second suction passage 1921 may be formed to correspond to the first suction passage 1912 in the axial direction. In other words, the second suction passage 1921 may be formed in the axial direction to correspond to the outlet side of the first suction passage 1912. Accordingly, the second suction passage 1921 may communicate with the first suction passage 1912 to guide refrigerant suctioned through the first suction passage 1912 to the suction chamber Vs.

Referring to FIGS. 13 and 14, the second suction passage 1921 may be formed through the fixed end plate 141 in a manner of being partially included in the inner circumferential surface of the fixed side wall portion 142. That is, the second suction passage 1921 may be formed between the inner circumferential surface of the fixed side wall portion 142 and the outer surface of the outermost fixed wrap 144 at a position where a part of the inner circumferential surface of the fixed side wall portion 142 is included.

Accordingly, the lower end of the second suction passage 1921 forming the inlet 1921*a* of the second suction passage 1921 may penetrate through the lower surface of the fixed end plate 141 in the axial direction, and thus have a circular shape at the fixed end plate 141. However, a portion including the outlet 1921*b* of the second suction passage 1921 outside the fixed end plate 141 may be formed in a substantially semicircular cross-sectional shape on the inner circumferential surface of the fixed side wall portion 142.

In addition, an upper end of the second suction passage 1921 may be formed to be recessed to the vicinity of the upper surface of the fixed end plate 141 without completely penetrating through the upper surface of the fixed end plate 141. That is, the upper end of the second suction passage 1921 may be half closed by the upper surface of the fixed side wall portion 142 and half opened, so as to form a valve stopper 1922 for supporting in the axial direction a back pressure surface 1951*b* of the suction passage opening and closing valve 195 (further explained below).

Then, the suction passage opening and closing valve 195 that is slidably inserted into the second suction passage 1921 may not be separated and may be limited at an open position by virtue of the valve stopper 1922 provided at the upper end of the second suction passage 1921. That is, a position at which the valve stopper 1922 is formed may become the maximum open position of the suction passage opening and closing valve 195.

In addition, a portion of the second suction passage 1921 between the lower end and the upper end of the second suction passage 1921 may penetrate through the inner circumferential surface of the fixed side wall portion 142 facing the outer surface of the outermost fixed wrap 144 to communicate with the suction chamber Vs. Therefore, the surface facing the outer circumferential surface of the outermost fixed wrap 144 may be opened from the upper surface of the fixed end plate 141 to the lower surface of the valve stopper 1922, so as to form the outlet 1921*b* of the second suction passage 1921.

In other words, the inlet 1921*a* of the second suction passage 1921 may be open in the axial direction while the outlet 1921*b* of the second suction passage 1921 may be open at a side surface in the radial direction. Accordingly, it may be advantageous in terms of stability of behavior of the suction passage opening and closing valve 195 (further described below) that the second suction passage 1921 is formed up to a position at which it is almost in contact with the outer surface of the outermost fixed wrap 144.

That is, as the outlet 1921*b* of the second suction passage 1921 according to the implementation is formed by opening the surface facing the outer surface of the outermost fixed wrap 144, the outer circumferential surface of the suction passage opening and closing valve 195 may partially be in a free state without being supported by the side surface of the second suction passage 1921. Therefore, when the outlet 1921*b* of the second suction passage 1921 is formed to be as close as possible to the outer surface of the outermost fixed wrap 144, the part of the outer circumferential surface of the suction passage opening and closing valve 195 may be supported in the radial direction by the outer surface of the outermost fixed wrap 144, and thus the behavior of the suction passage opening and closing valve 195 may be stabilized.

An inlet height H1 of the second suction passage 1921 may be greater than or equal to a thickness (axial height) t1 of the suction passage opening and closing valve 195 (further described below). For example, the inlet height H1 of the second suction passage 1921 may be high enough that the outer circumferential surface of the suction passage opening and closing valve 195 at a closed position P1 of the suction passage opening and closing valve 195 is inserted into the inlet 1921*a* of the second suction passage 1921 so as not to be exposed to the outlet 1921*b* of the second suction passage 1921.

In addition, an outlet height H2 of the second suction passage 1921 may be greater than the thickness (axial height) t1 of the suction passage opening and closing valve 195 (further described below). For example, the outlet height H2 of the second suction passage 1921 may be set in a manner that the back pressure surface 1951*b* of the suction passage opening and closing valve 195 is exposed to the suction chamber Vs at the closed position P1 of the suction passage opening and closing valve 195 and an opening and closing surface 1951*a* of the suction passage opening and closing valve 195 is exposed to the suction chamber Vs at the open position P2 of the suction passage opening and closing valve 195.

Meanwhile, the second suction passage 1921 according to the implementation may be formed to have the same inner diameter as or a different inner diameter from the first suction passage 1912.

Figure 15A:
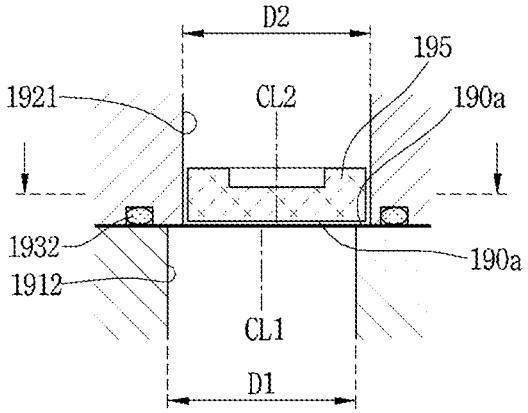
FIGS. 15A and 15B are schematic diagrams illustrating a suction passage and a suction passage opening and closing valve in an assembled state, according to an implementation of the present disclosure.
Figure 15B:
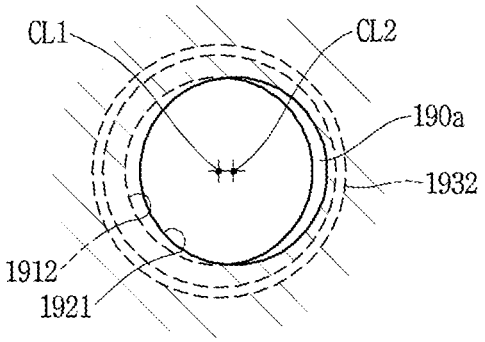
Figure 16A:
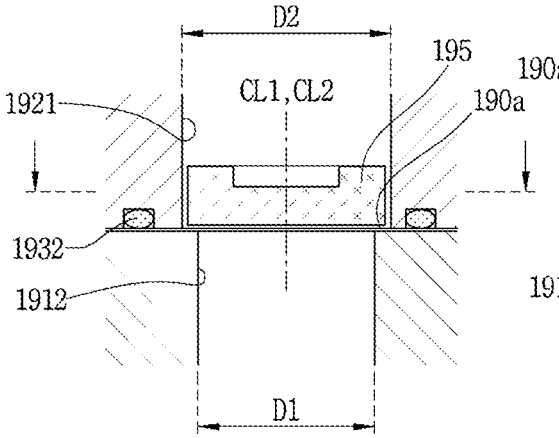
FIGS. 16A and 16*b* are schematic diagrams illustrating a suction passage and a suction passage opening and closing valve are assembled, according to another implementation of the present disclosure.
Figure 16B:
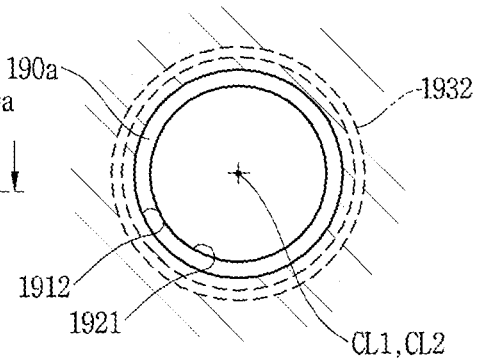

FIGS. 15A and 15B are schematic diagrams illustrating that the suction passage and the suction passage opening and closing valve are assembled according to an implementation of the present disclosure, and FIGS. 16A and 16B are schematic diagrams illustrating the suction passage and the suction passage opening and closing valve are assembled according to another implementation of the present disclosure.

That is, FIGS. 15A and 15B illustrate a case where the inner diameter of the second suction passage (in particular, the inner diameter of the inlet of the second suction passage) is the same as the inner diameter of the first suction passage (in particular, the inner diameter of the outlet of the first suction passage), and FIGS. 16A and 16B illustrate a case where the inner diameter of the second suction passage is greater than the inner diameter of the first suction passage.

Referring to FIGS. 15A and 15B, when the inner diameter D2 of the second suction passage 1921 is the same as the inner diameter D1 of the first suction passage 1912, the inlet of the second suction passage 1921 may be misaligned with the outlet of the first suction passage 1912.

For example, as illustrated in FIG. 15A, the inlet 1921*a* of the second suction passage 1921 and the outlet 1912*b* of the first suction passage 1912 facing the inlet 1921*a* may be arranged on different axial lines. Specifically, an axial center line CL2 at the inlet 1921*a* of the second suction passage 1921 may be located to be eccentric outward (or inward) in the radial direction from an axial center line CL1 at the outlet 1912*b* of the first suction passage 1912.

Then, a stepped surface, which is not obscured by the second suction passage 1921, may be formed around the outlet 1912*b* of the first suction passage 1912. In other words, the stepped surface may be formed to have an arcuate cross-section in a crescent shape on an end surface of the outlet side of the first suction passage 1912. This stepped surface may define a valve seat surface 190*a* for supporting the opening and closing surface 1951*a* of the suction passage opening and closing valve 195 (further described below).

The suction passage opening and closing valve 195 may thus be supported by the valve seat surface 190*a* in the axial direction to block the suction passage 190. Therefore, the valve seat surface 190*a* may be the closed position P1 of the suction passage opening and closing valve 195.

On the other hand, even if the inner diameter D1 of the first suction passage 1912 is greater than the inner diameter D2 of the second suction passage 1921, the outlet 1912*b* of the first suction passage 1912 and the inlet 1921*a* of the second suction passage 1921 may be disposed eccentrically to each other. Even in this case, the valve seat surface 190*a* having an arcuate cross-sectional shape may be formed on the end surface of the first suction passage 1912 at the side of the outlet 1912*b*.

Referring to FIGS. 16A and 16B, when the inner diameter D2 of the second suction passage 1921 is greater than the inner diameter D1 of the first suction passage 1912, the valve seat surface 190*a* may be formed on an end surface of the outlet side of the first suction passage 1912 while the inlet 1921*a* of the second suction passage 1921 and the outlet 1912*b* of the first suction passage 1912 are disposed on the same axial line. (See FIG. 16A)

The valve seat surface 190*a* according to the implementation may be formed in an annular shape unlike the implementation illustrated in FIG. 13. Then, the valve seat surface 190*a* according to this implementation may evenly support an edge of the opening and closing surface 1951*a* of the suction passage opening and closing valve 195, thereby more stably supporting the suction passage opening and closing valve 195.

Meanwhile, the second suction passage sealing member 1932 may be provided between a periphery of the outlet 1912*b* of the first suction passage 1912 and a periphery of the inlet 1921*a* of the second suction passage 1921. The second suction passage sealing member 1932 may be formed in an annular shape like an O-ring to surround the periphery of the outlet 1912*b* of the first suction passage 1912 or the periphery of the inlet 1921*a* of the second suction passage 1921. However, the second suction passage sealing member 1932 may extend from a gasket for sealing a gap between the lower surface of the fixed scroll 140 and the cover flange portion 162 of the discharge cover 160.

An installation position of the second suction passage sealing member 1932 may be limited depending on an arrangement between the outlet 1912*b* of the first suction passage 1912 and the inlet 1921*a* of the second suction passage 1921.

For example, when the inlet 1921*a* of the second suction passage 1921 and the outlet 1912*b* of the first suction passage 1912 are arranged eccentrically to each other as illustrated in FIG. 15A, the center of the second suction passage sealing member 1932 may be disposed to be eccentric with respect to the center of the suction passage 190 as illustrated in FIG. 15B. Accordingly, even if the inlet 1921*a* of the second suction passage 1921 is disposed to be eccentric with respect to the outlet 1912*b* of the first suction passage 1912, a sealing area for the first suction passage 1912 and the second suction passage 1921 can be secured. This is also similar to a case of being eccentric in an opposite direction.

On the other hand, when the inlet 1921*a* of the second suction passage 1921 and the outlet 1912*b* of the first suction passage 1912 are coaxially arranged as illustrated in FIG. 16A, the center of the second suction passage sealing member 1932 may be coaxially disposed with respect to the center of the suction passage as illustrated in FIG. 16B. In other words, in this case, the second suction passage sealing member 1932 may be arranged to be positioned concentrically with respect to the outlet 1912*b* of the first suction passage 1912 and the inlet 1921*a* of the second suction passage 1921. This may more facilitate the installation of the second suction passage sealing member 1932 and secure a sealing length more sufficiently.

On the other hand, the suction passage opening and closing valve 195 according to the implementation, as described above, may be slidably inserted into the second suction passage 1921 in the axial direction to open or close the suction passage by a difference in pressure applied to each of both side surfaces of the suction passage opening and closing valve 195 in the axial direction.

Referring back to FIG. 10, the suction passage opening and closing valve 195 may include a valve body portion 1951 and a valve guide portion 1952. The valve body portion 1951 may be formed in a disk shape, and the valve guide portion 1952 may extend in the axial direction from an upper surface of the valve body portion 1951.

The valve body portion 1951 and the valve guide portion 1952 may be formed of the same material or different materials. For example, all or parts of the valve body portion 1951 and the valve guide portion 1952 may be formed of a metal material or a plastic material.

The valve body portion 1951 may be formed in a simple disk shape in which one side surface thereof facing the discharge cover 160 defines the opening and closing surface 1951*a* and an opposite side surface defines the back pressure surface 1951*b*. The valve body portion 1951 may have an inner diameter greater than the inner diameter of the first suction passage 1912, more specifically, the inner diameter of the valve seat surface 190*a*. Accordingly, the valve body portion 1951 of the suction passage opening and closing valve 195 may open or close the suction passage 190 by being attached to or detached from the valve seat surface 190*a*.

The valve guide portion 1952 may be formed in an annular shape. The valve guide portion 1952 may have an outer diameter which is substantially the same as the inner diameter of the second suction passage 1921. Accordingly, when the suction passage opening and closing valve 195 slides up and down along the axial direction inside the second suction passage 1921, the valve guide portion 1952 may suppress fluctuation of the suction passage opening and closing valve 195, thereby enhancing stability and responsiveness of the valve.

In addition, an axial thickness t1 of the suction passage opening and closing valve 195 including the valve body portion 1951 and the valve guide portion 1952 may be smaller than or equal to the inlet height H1 of the second suction passage 1921 and smaller than the outlet height H2 of the second suction passage 1921. Accordingly, a friction area can be reduced when opening and closing the suction passage opening and closing valve 195, and the maximum outlet area of the second suction passage 1921 can be secured at the open position P2 of the suction passage opening and closing valve 195.

Also, when the valve guide portion 1952 is formed in the annular shape as in this implementation, a refrigerant accommodating space 195*a* or the like may be defined inside the valve guide portion 1952. The refrigerant accommodating space 195*a* may have a volume equal to the height of the valve guide portion 1952.

Accordingly, when the suction passage opening and closing valve 195 is closed, refrigerant may be collected in the refrigerant accommodating space 195*a* defined by the valve guide portion 1952 and press the valve body portion 1951 of the suction passage opening and closing valve 195 in the axial direction. This may allow the suction passage opening and closing valve 195 to more quickly and closely block the suction passage 190. In this way, the responsiveness and reliability of the suction passage opening and closing valve 195 can be enhanced.

In addition, the valve guide portion 1952 may have a width that is thin enough that the refrigerant accommodating space 195*a* is not covered by the valve stopper 1922. If the valve guide portion 1952 is formed too thick, the refrigerant accommodating space 195*a* may be covered by the valve guide portion 1952 in a state in which the suction passage opening and closing valve 195 is raised up to the open position P2.

Then, high-pressure refrigerant flowing back from the compression chamber V may not flow smoothly into the refrigerant accommodating space 195*a*, thereby delaying a closing operation of the valve. Therefore, the width W1 of the valve guide portion 1952 may preferably be smaller than a gap W2 between the inner circumferential surface of the valve stopper 1922 and the outer circumferential surface of the outermost fixed wrap 144 facing the inner circumferential surface. (See FIG. 14)

As the valve guide portion 1952 is formed in the annular shape, the thickness of the valve may be increased by the height of the valve guide portion 1952 without excessively increasing a weight of the suction passage opening and closing valve 195. In this manner, a contact area between the suction passage opening and closing valve 195 and the second suction passage 1921 may be enlarged, so as to stabilize the behavior of the suction passage opening and closing valve 195 even when the inner circumferential surface of the second suction passage 1921 is partially opened.

Accordingly, the suction passage opening and closing valve 195 according to the implementation may be operated by a difference in pressure applied to the opening and closing surface 1951*a* and the back pressure surface 1951*b* in the state of being slid into the first suction passage 1912 in the axial direction.

Referring back to FIG. 11, during the operation of the compressor 10, the suction passage opening and closing valve 195 may be pushed up by force of suctioned refrigerant, as illustrated with a dotted line, to be separated from the valve seat surface 190*a*, thereby opening the suction passage 190. Then, the refrigerant may be smoothly suctioned from the refrigerant suction pipe 115 into the suction chamber Vs through the first suction passage 1912 and the second suction passage 1921.

On the other hand, during the compressor being stopped, as indicated by a solid line, the suction passage opening and closing valve 195 may be pushed down by the weight of the valve and pressure of fluid (oil or refrigerant) flowing back from the compression chamber V to the refrigerant suction pipe 115, so as to be in close contact with the valve seat surface 190*a*. Then, the suction passage opening and closing valve 195 may block the suction passage 190, thereby preventing the oil and refrigerant from flowing back from the compression chamber V to the refrigerant suction pipe 115.

Hereinafter, a description will be given of another implementation of the suction passage opening and closing valve.

In the foregoing implementation, the outer diameter of the valve guide portion is substantially the same as the outer diameter of the valve body portion. However, in some cases, the outer diameter of the valve guide portion may be different from the outer diameter of the valve body portion.

Figure 17:
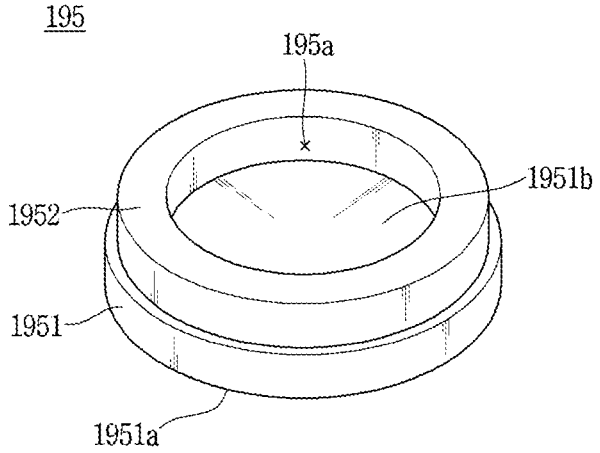
FIG. 17 is a perspective view illustrating another implementation of a suction passage opening and closing valve.
Figure 18:
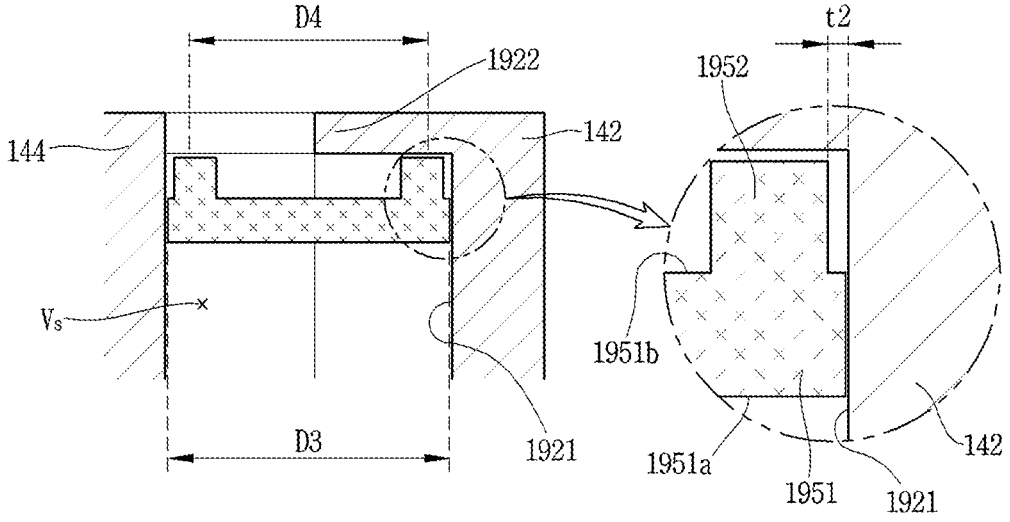
FIG. 18 is a sectional view illustrating that the suction passage opening and closing valve according to FIG. 17 is inserted in a suction passage.

FIG. 17 is a perspective view illustrating another implementation of the suction passage opening and closing valve, and FIG. 18 is a sectional view illustrating a state in which the suction passage opening and closing valve according to FIG. 17 is inserted in a suction passage.

As illustrated in FIGS. 17 and 18, an outer diameter D4 of the valve guide portion 1952 may be slightly smaller than an outer diameter D3 of the valve body portion 1951. Accordingly, the outer circumferential surface of the valve body portion 1951 and the inner circumferential surface of the second suction passage 1921 may be almost in contact with each other, but there may be a preset interval t2 between the outer circumferential surface of the valve guide portion 1952 and the inner circumferential surface of the second suction passage 1921.

As described above, in the case where the outer diameter D4 of the valve guide portion 1952 is smaller than the outer diameter D3 of the valve body portion 1951, the valve guide portion 1952 may be spaced apart from the inner circumferential surface of the second suction passage 1921 when the suction passage opening and closing valve 195 moves in the axial direction.

Accordingly, even when the axial movement of the suction passage opening and closing valve 195 is slightly unstable due to being subjected to uneven pressure, the overall thickness t1 of the suction passage opening and closing valve 195 including the valve body portion 1951 and the valve guide portion 1952 may be increased to stabilize the valve behavior.

On the other hand, when the suction passage opening and closing valve 195 moves almost normally along the axial direction, the outer circumferential surface of the valve guide portion 1952 and the inner circumferential surface of the second suction passage 1921 may be spaced apart from each other by a preset interval t2. Accordingly, a friction area between the outer circumferential surface of the suction passage opening and closing valve 195 and the inner circumferential surface of the second suction passage 1921 may be reduced, which may result in quickly opening or closing the suction passage opening and closing valve 195.

Hereinafter, a description will be given of yet another implementation of the suction passage opening and closing valve.

In the foregoing implementation, the upper end of the valve guide portion is formed flat. However, in some cases, the upper end of the valve guide portion may be formed unevenly.

Figure 19:
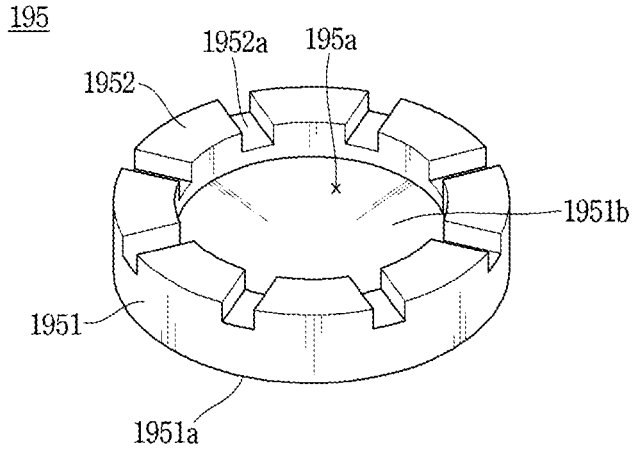
FIG. 19 is a perspective view illustrating another implementation of the suction passage opening and closing valve.
Figure 20:
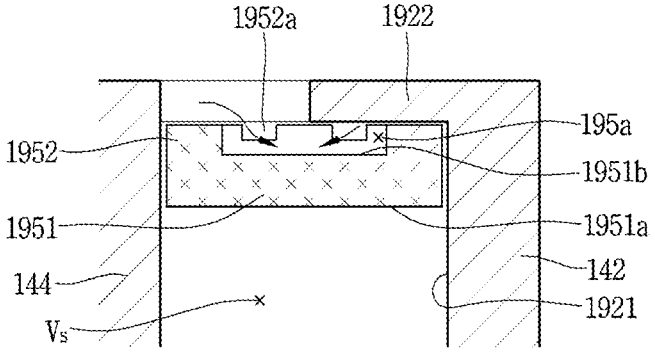
FIG. 20 is a sectional view illustrating that the suction passage opening and closing valve according to FIG. 19 is inserted in a suction passage.

FIG. 19 is a perspective view illustrating yet another implementation of the suction passage opening and closing valve, and FIG. 20 is a sectional view illustrating a state in which the suction passage opening and closing valve according to FIG. 19 is inserted in a suction passage.

As illustrated in FIGS. 19 and 20, the valve guide portion 1952 of the suction passage opening and closing valve 195 according to this implementation may have a communication groove 1952*a* formed on its end surface, which is an upper end. For example, the outer circumferential surface and the inner circumferential surface of the valve guide portion 1952 may communicate with each other through the communication groove 1952*a* which is formed in a penetrating manner. Only one communication groove 1952*a* may be formed, but in some cases, a plurality of communication grooves 1952*a* may be formed at preset intervals along the circumferential direction.

Accordingly, even if the compressor 10 is stopped in a state in which the suction passage opening and closing valve 195 is pushed up to be in close contact with the open position P2, high-pressure refrigerant or oil which flows backward may be quickly introduced into the refrigerant accommodating space 195*a* of the suction passage opening and closing valve 195.

That is, when the compressor 10 is stopped, the suction passage opening and closing valve 195 should quickly move down to block the suction passage 190, so as to minimize the flow of high temperature and high-pressure refrigerant and oil back to the refrigerant suction pipe 115.

At this time, at the open position P2 of the suction passage opening and closing valve 195, the end surface of the valve guide portion 1952 may be brought into close contact with the valve stopper 1922, which may make the backwardly-flowing refrigerant or oil difficult to be smoothly introduced into the valve guide portion 1952. As a result, when the compressor 10 is stopped, the suction passage opening and closing valve 195 may be pushed down only by its own weight, and the closing operation may be delayed.

However, when the communication groove 1952*a* is formed through the end surface of the valve guide portion 1952 as in this implementation, a part of the refrigerant (or oil) flowing backward may be introduced into the refrigerant accommodating space 195*a* through the communication groove 1952*a*. Then, a high-pressure fluid may apply pressure in a closing direction to the back pressure surface 1951*b* of the suction passage opening and closing valve 195 from a time point when the compressor is stopped. Accordingly, the suction passage opening and closing valve 195 may be pushed down more quickly by its own weight and the pressure of the fluid to block the suction passage 190, thereby improving the valve responsiveness.

Hereinafter, a description will be given of yet another implementation of the suction passage opening and closing valve.

In the foregoing implementation, the valve body portion and the valve guide portion are provided. However, in some cases, only the valve body portion may be provided.

Figure 21:
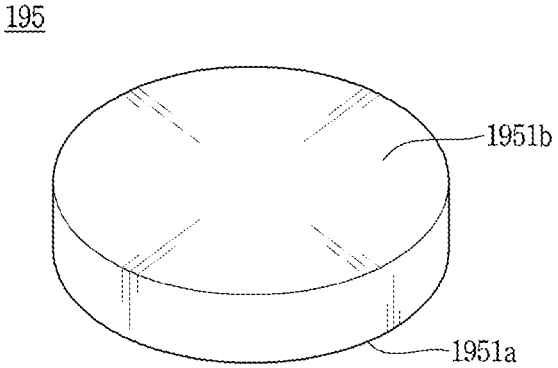
FIG. 21 is a perspective view illustrating another implementation of the suction passage opening and closing valve.

FIG. 21 is a perspective view illustrating yet another implementation of the suction passage opening and closing valve.

As illustrated in FIG. 21, the suction passage opening and closing valve 195 according to this implementation may be formed in a simple disk shape.

For example, the suction passage opening and closing valve 195 may include a valve body portion 1951. The valve body portion 1951 may include an opening and closing surface 1951*a* facing the first suction passage 1912, and a back pressure surface 1951*b* facing the valve stopper 1922. Each of the opening and closing surface 1951*a* and the back pressure surface 1951*b* may be formed flat. An axial thickness t1 of the valve body portion 1951 may be smaller than or equal to the inlet height H1 of the second suction passage 1921 and smaller than the outlet height H2 of the second suction passage 1921.

In addition, the whole valve body portion 1951 of the suction passage opening and closing valve 195 may be formed of a metal material in which a single or a plurality of materials is alloyed. Accordingly, even if the valve body portion 1951 constituting the suction passage opening and closing valve 195 is formed in a thin plate shape, when the compressor 10 is stopped, the suction passage opening and closing valve 195 may be quickly pushed down by the weight of the valve body portion 1951.

However, the suction passage opening and closing valve 195 may be formed of a relatively light material such as engineer plastic. However, in this case, the valve body portion 1951 may preferably have a preset thickness to secure a weight that is required for an instantaneous closing operation when the compressor is stopped.

Hereinafter, a description will be given of yet another implementation of the suction passage opening and closing valve.

In the foregoing implementation, the suction passage opening and losing valve is operated by the weight of the valve itself and the pressure of the fluid which flows backward. However, in some cases, elastic force may also be applied in addition to the weight of the valve and the pressure of the fluid.

Figure 22:
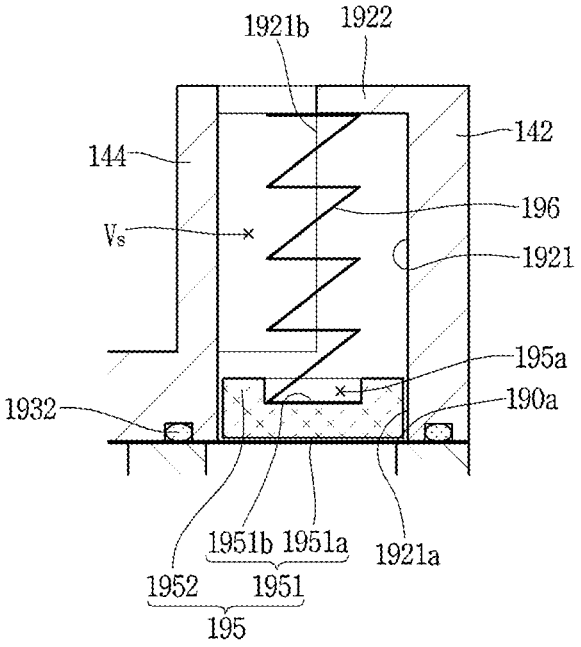
FIG. 22 is a sectional view illustrating an implementation of an elastic member for supporting a suction passage opening and closing valve.
Figure 23:
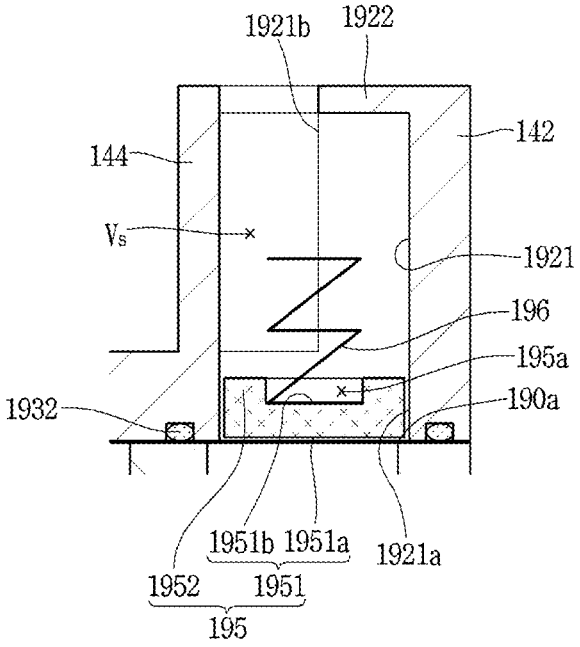
FIG. 23 is a sectional view illustrating another implementation of the elastic member for supporting a suction passage opening and closing valve.

FIG. 22 is a sectional view illustrating an implementation of an elastic member for supporting a suction passage opening and closing valve, and FIG. 23 is a sectional view illustrating another implementation of the elastic member for supporting a suction passage opening and closing valve.

As illustrated in FIGS. 22 and 23, the suction passage opening and closing valve 195 according to this implementation may be provided with an elastic member 196 on the back pressure surface 1951*b*. The elastic member 196 may be configured as a compression coil spring, a leaf spring, or a member made of a material having elasticity such as rubber. This implementation illustrates an example in which the elastic member 196 is configured as a compression coil spring.

As illustrated in FIG. 22, the elastic member 196 may be provided between the valve body portion 1951 of the suction passage opening and closing valve 195 and the valve stopper 1922 of the fixed scroll 140. One end of the elastic member 196 may be supported by the valve stopper 1922, and another end of the elastic member 196 may be supported by the back pressure surface 1951*b* of the valve body portion 1951.

For example, one end of the elastic member 196 may be inserted into the inner circumferential surface of the valve guide portion 1952. Spring support portions may be formed on the valve stopper 1922 and/or the suction passage opening and closing valve 195.

As described above, when the elastic member 196 is disposed between the suction passage opening and closing valve 195 and the valve stopper 1922, the suction channel opening and closing valve 195 may be moved to the closed position P1 more quickly by elastic force of the elastic member 196 in addition to the weight of the valve and the pressure of the fluid in the stopped state of the compressor. Accordingly, the suction passage opening and closing valve 195 may block the suction passage more quickly, thereby enhancing efficiency of the compressor.

In addition, the elastic member 196 may be set to have appropriate elastic force which is enough to maintain the suction passage opening and closing valve 195 at the closed position P1 in the stopped state of the compressor 10 and to push the suction passage opening and closing valve 195 up to the open position P2 during the operation of the compressor 10.

Accordingly, since resistance due to the elastic member 196 is not large at the beginning of the operation of the compressor 10 or during the operation of the compressor 10, the suction passage opening and closing valve 195 can be quickly moved to the open position P2 by suctioned refrigerant. On the other hand, when the compressor 10 is stopped, restoring force may be applied to the suction passage opening and closing valve 195 as described above, so that the suction passage opening and closing valve 195 can quickly return to the closed position P1.

The elastic member 196 may also stabilize the behavior of the suction passage opening and closing valve 195. Specifically, the behavior of the suction passage opening and closing valve 195 may be limited by the elastic member 196. Accordingly, even if the opening and closing surface 1951*a* or the back pressure surface 1951*b* of the suction passage opening and closing valve 195 is subject to slightly uneven pressure, the elastic member 196 may serve as a guide or the like while stably maintaining the behavior of the suction passage opening and closing valve 195.

On the other hand, the elastic member 196 according to this implementation may be short in length. As illustrated in FIG. 23, an axial length of the elastic member 196 may be shorter than a gap between the back pressure surface 1951*b* of the suction passage opening and closing valve 195 and the valve stopper 1922 at the closed position P1 of the suction passage opening and closing valve 195.

In this case, the elastic member 196 may be fixed to only one of the back pressure surface 1951*b* of the suction passage opening and closing valve 195 or the valve stopper 1922. In consideration of the weight of the suction passage opening and closing valve 195, it may be advantageous to install the elastic member 196 on the valve stopper 1922. However, in consideration of the fact that the suction passage opening and closing valve 195 having a predetermined weight can increase a closing effect by its own weight, the elastic member 196 may be disposed on the back pressure surface 1951*b* of the suction passage opening and closing valve 195.

Accordingly, the elastic member 196 may transmit restoring force to the suction passage opening and closing valve 195 at the moment the compressor 10 is stopped, so that the suction passage opening and closing valve 195 can be quickly separated from the valve stopper 1922, so as to quickly move to the closed position P1. In this way, in the high-pressure and bottom-compression type scroll compressor, the suction passage opening and closing valve can be provided between the outlet of the refrigerant suction pipe and the inlet of the compression unit. Accordingly, when the compressor is stopped, oil or refrigerant in the casing can be quickly blocked so as not to flow back to the refrigerant suction pipe through the compression unit.

This may result in minimizing a contact between refrigerant suctioned upon the restart of the compressor and high-pressure oil or refrigerant which flows backward, thereby preventing an increase in a specific volume of the suctioned refrigerant. In addition, reliability of the compressor may be enhanced and friction loss may be reduced by suppressing wear between members that may occur due to an oil shortage inside the casing, thereby improving compression efficiency.

Also, the suction passage opening and closing valve that blocks oil or refrigerant from flowing back toward the refrigerant suction pipe through the compression unit may be operated in the axial direction, so as to move to the closed position quickly by its own weight. This may simplify the structure of the suction passage opening and closing valve, so as to reduce a fabricating cost and simultaneously improve the responsiveness of the valve, thereby enhancing the compression efficiency.

Furthermore, the suction passage may be formed in the discharge cover or the fixed scroll, and the refrigerant suction pipe may be connected to the suction passage at a position lower than the compression chamber. Accordingly, the suction passage can be located in the oil storage space located below the compression unit and the suction passage opening and closing valve for opening or closing the suction passage can be installed to be operated in the axial direction. Accordingly, in the high-pressure and bottom-compression type scroll compressor, the back flow of the oil or refrigerant toward the suction side can be effectively suppressed while maintaining the axial length of the casing, thereby reducing the size of the compressor and enhancing the compression efficiency.

Hereinafter, a description will be given of another implementation of the suction passage of the scroll compressor according to the present disclosure.

In the foregoing implementation, the refrigerant suction pipe is connected to the second suction passage provided in the discharge cover. However, in some cases, the suction passage may entirely be formed in the fixed scroll so that the refrigerant suction pipe can communicate with the first suction passage of the fixed scroll. Of course, even in this case, the structure in which the suction passage opening and closing valve is provided inside the casing is the same as in the foregoing implementation, and the basic effects thereof are also the same as in the foregoing implementation.

Figure 24:
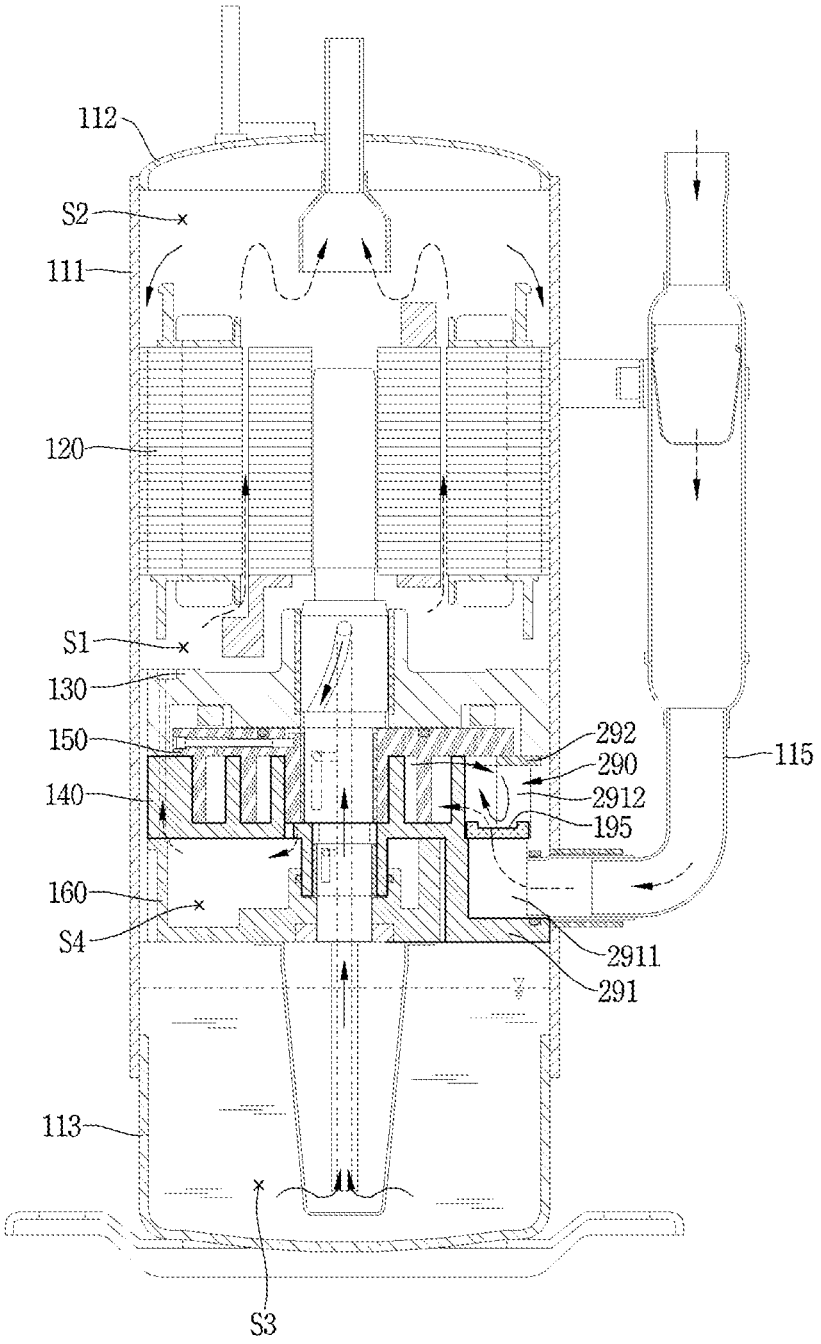
FIG. 24 is a longitudinal sectional view illustrating another implementation of the suction passage in a bottom-compression type scroll compressor in accordance with implementations of the present disclosure.
Figure 25:
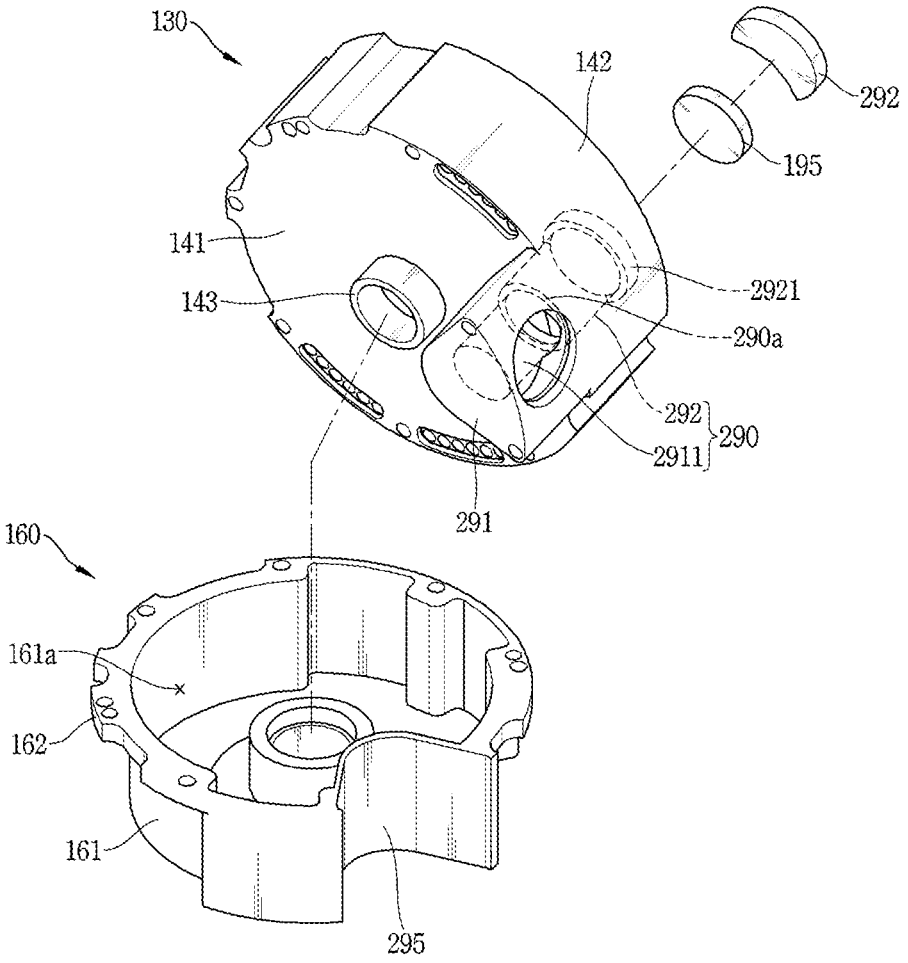
FIG. 25 is an exploded perspective view of a fixed scroll and a discharge cover in FIG. 24.
Figure 26:
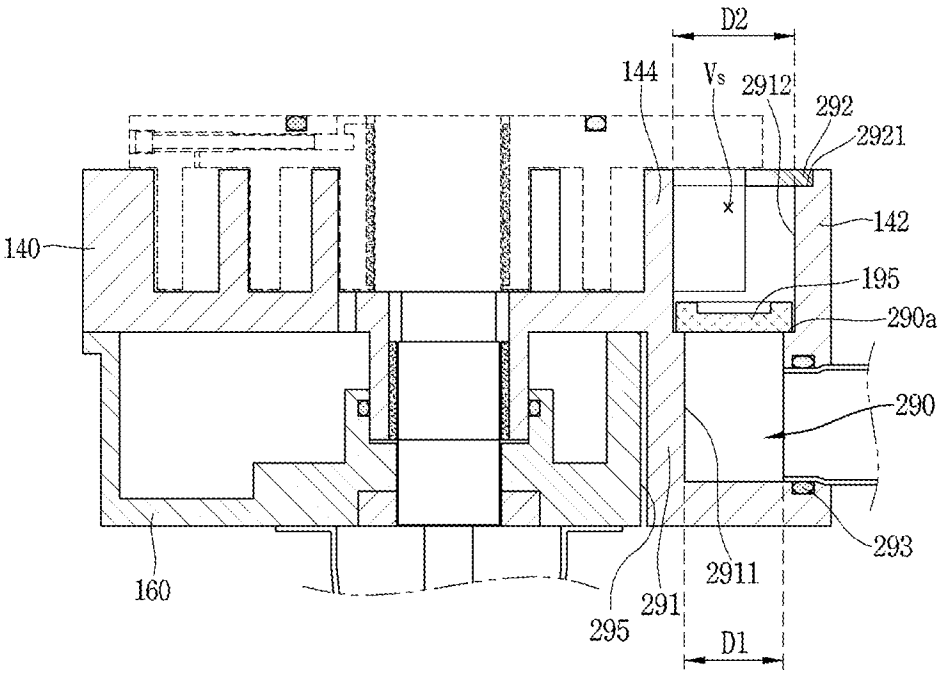
FIG. 26 is a sectional view of the fixed scroll and the discharge cover of FIG. 25 in an assembled state.

FIG. 24 is a longitudinal sectional view illustrating another implementation of the suction passage in a bottom-compression type scroll compressor in accordance with an implementation, FIG. 25 is an exploded perspective view of a fixed scroll and a discharge cover in FIG. 24, and FIG. 26 is a sectional view of the fixed scroll and the discharge cover of FIG. 25 in an assembled state.

As illustrated in FIGS. 24 to 25, a suction passage 290 according to an implementation may include a first suction passage 2911 and a second suction passage 2912 provided in the fixed scroll 140. The first suction passage 2911 and the second suction passage 2912 may be continuously formed along the axial direction.

The first suction passage 2911 may be formed through the inside of a suction guide protrusion 291. For example, the suction guide protrusion 291 may extend from the lower surface of the fixed end plate 141 toward the discharge cover 160 by a preset length in the axial direction.

In addition, the suction guide protrusion 291 may be formed in substantially the same shape as the suction guide protrusion 1911 provided in the discharge cover 160 in the foregoing implementation of FIG. 2. However, the suction guide protrusion 291 according to this implementation may be spaced apart from the outer circumferential surface of the discharge cover 160 by a preset interval.

This structure may prevent the suction guide protrusion 291 from being heated by refrigerant accommodated in the discharge space S4 of the discharge cover 160. Also, refrigerant which is suctioned into the compression chamber V through the first suction passage 2911 during the operation of the compressor can be prevented from being heated in advance by refrigerant discharged to the discharge cover 160. Accordingly, an increase in a specific volume of the refrigerant suctioned into the compression chamber can be suppressed. This may cause a reduction of suction loss, resulting in enhancing compression efficiency.

The first suction passage 2911 may be formed by being bent toward the fixed end plate 141 from the outer circumferential surface of the suction guide protrusion 291. For example, one end of the first suction passage 2911 may penetrate through a side surface of the suction guide protrusion 291 in the radial direction toward the inner circumferential surface of the casing 110, and another end of the first suction passage 2911 may penetrate through a side surface of the suction guide protrusion 291 in the axial direction toward the second suction passage 2912.

Accordingly, the refrigerant suction pipe 115 penetrating through the casing 110 may be inserted into the one end of the first suction passage 2911, and the another end of the first suction passage 2911 may communicate with the second suction passage 2912.

In addition, in the foregoing implementation, a valve seat surface 290*a* may be formed between the first suction passage 2911 and the second suction passage 2912. However, as the first suction passage 2911 and the second suction passage 2912 are formed at the fixed scroll 140, the valve seat surface 290*a* may be defined by forming the first suction passage 2911 and the second suction passage 2912 to have different inner diameters.

For example, as the inner diameter D1 of the first suction passage 2911 is smaller than the inner diameter D2 of the second suction passage 2912, a stepped portion may be formed on an end surface of the first suction passage 2911. The stepped portion may define the valve seat surface 290*a*.

In this case, an axial center line of the first suction passage 2911 and an axial center line of the second suction passage 2912 may be formed on the same axial line or on different axial lines. For example, when the first suction passage 2911 and the second suction passage 2912 are formed on the same axial line, the valve seat surface 290*a* may be formed in an annular shape. On the other hand, when the first suction passage 2911 and the second suction passage 2912 are formed on different axial lines, the valve seat surface 290*a* may be formed in an arcuate shape like a crescent moon.

Meanwhile, the second suction passage 2912 may be recessed by a preset depth toward an end of the fixed wrap 144 between the fixed side wall portion 142 of the fixed scroll 140 and the outer surface of the outermost fixed wrap 144 facing the fixed side wall portion 142. The second suction passage 2912 may be formed substantially the same as the second suction passage 1921 in FIG. 2. Therefore, the second suction passage 2912 according to this implementation will be understood similarly based on the description of the second suction passage 1921 illustrated in the foregoing implementation.

However, since the second suction passage 2912 in this implementation is formed in the fixed scroll 140 together with the first suction passage 2911, the suction passage 290 including the first suction passage 2911 and the second suction passage 2912 may be opened at one side and closed at another side in the axial direction.

That is, the suction passage 290 may be formed in the penetrating manner from the lower end side or the upper end side of the fixed scroll 140. This implementation illustrates an example in which the suction passage 290 penetrates from the lower end side, namely, from the fixed wrap 144 of the fixed scroll 140 toward the fixed end plate 141. This is also advantageous in forming the valve seat surface 290*a*.

For example, the second suction passage 2912 may be opened at both ends in the axial direction, and a valve support plate 292 for forming a valve stopper may be inserted into the upper end of the second suction passage 2912. The valve support plate 292 may be formed to have an approximately semicircular cross-section and may be press-fitted or coupled to a support plate insertion groove 2921 provided in the upper end of the fixed side wall portion 142. At this time, as the frame side wall portion 132 of the main frame 130 is coupled to be in close contact with the upper end of the fixed side wall portion 142, the valve support plate 292 may also be supported in the axial direction using the frame side wall portion 132.

On the other hand, since the basic shape of the suction passage opening and closing valve 195 according to this implementation and its operation effects are the same as those of the foregoing implementations, a description of the suction passage opening and closing valve 195 in this implementation is omitted, and the description of the suction passage opening and closing valve in the foregoing implementations are incorporated by reference with respect to this implementation.

In this implementation, the first suction passage 2911 and the second suction passage 2912 constituting the suction passage 290 may be integrally formed with the fixed scroll 140, which may facilitate the formation of the suction passage 290.

In addition, in this implementation, the refrigerant suction pipe 115 may be fixedly fitted to the inner circumferential surface of the first suction passage 2911, a suction passage sealing member 293 may be provided between the inner circumferential surface of the first suction passage 2911 and the outer circumferential surface of the refrigerant suction pipe 115.

However, as described above, since the first suction passage 2911 and the second suction passage 2912 are integrally formed with the fixed scroll 140, a separate sealing member may not be needed between the first suction passage 2911 and the second suction passage 2912.

Accordingly, the exclusion of the sealing member for sealing between the first suction passage 2911 and the second suction passage 2912 may result in reduction of the number of components.

In addition, in this implementation, as the suction guide protrusion 291 extends from the fixed scroll 140 toward the discharge cover 160, a suction passage accommodation groove 295 in which the suction guide protrusion 291 is inserted may be formed in the outer circumferential surface of the discharge cover 160.

The suction passage accommodation groove 295 may be recessed in the radial direction toward the central portion of the discharge cover 160. In this case, the suction guide protrusion 291 of the fixed scroll 140 may be spaced apart from the suction passage accommodation groove 295 of the discharge cover 160. Accordingly, suction refrigerant passing through the first suction passage 2911 can be suppressed from being heated by refrigerant in the discharge space S4, thereby improving suction efficiency of the refrigerant.

What is claimed is:

1. A scroll compressor comprising:

a casing;

a main frame provided in the casing;

a fixed scroll having (i) a fixed end plate coupled to the main frame, (ii) a fixed wrap defined at a first side surface of the fixed end plate, and (iii) a discharge port defined through the fixed end plate at a side of the fixed wrap;

an orbiting scroll having (i) an orbiting end plate located between the main frame and the fixed scroll, and (ii) an orbiting wrap defined at a side surface of the orbiting end plate, the orbiting wrap being configured to engage with the fixed wrap to thereby define a compression chamber in engagement with the fixed wrap;

a discharge cover defining a discharge space that accommodates an outlet of the discharge port, the discharge cover being coupled to a second side surface of the fixed end plate opposite to the first side surface of the fixed end plate;

a refrigerant suction pipe coupled to the discharge cover through the casing in a radial direction to supply refrigerant to the compression chamber;

a suction passage in fluid communication with the refrigerant suction pipe and the compression chamber; and a suction passage opening and closing valve provided inside the suction passage and configured to slide in an axial direction to thereby selectively open or close the suction passage, wherein the suction passage comprises:

a first suction passage defined at the discharge cover and connected to the refrigerant suction pipe, and a second suction passage defined at the fixed scroll and having first and second ends, the first end being in fluid communication with the first suction passage, and the second end being in fluid communication with the compression chamber, wherein the second suction passage is located gravitationally above the first suction passage in the axial direction, and wherein the suction passage opening and closing valve is inserted into the second suction passage and configured to slide in the axial direction.

2. The scroll compressor of claim 1, wherein the refrigerant suction pipe is coupled to the discharge cover or the fixed scroll at an axial height that is different from an axial height of the compression chamber.

3. The scroll compressor of claim 1, wherein the discharge cover includes:

a housing portion having the discharge space that accommodates the discharge port, and a suction guide protrusion protruding from a side wall surface of the housing portion toward a central portion of the discharge space, and wherein the first suction passage extends between (i) a radial side surface of the discharge cover facing an inner circumferential surface of the casing and (ii) an axial side surface of the discharge cover facing the fixed scroll.

4. The scroll compressor of claim 1, wherein the fixed scroll includes a fixed side wall portion defined at an edge of the fixed end plate, the fixed side wall portion having an annular shape, and wherein the second suction passage is recessed between the fixed side wall portion and an outer surface of an outermost fixed wrap facing the fixed side wall portion.

5. The scroll compressor of claim 4, wherein the second suction passage is partially defined at an inner circumferential surface of the fixed side wall portion, the second suction passage being recessed in the radial direction, and wherein the fixed side wall portion includes a valve stopper defined at an end of the inner circumferential surface and configured to support the suction passage opening and closing valve.

6. The scroll compressor of claim 5, wherein the second suction passage has an inlet defined through the fixed end plate toward the first suction passage, and wherein the second suction passage has an outlet that faces the outer surface of the outermost fixed wrap.

7. The scroll compressor of claim 1, wherein an axial center of the first suction passage and an axial center of the second suction passage are disposed to be eccentric to each other to thereby define a valve seat surface at a boundary surface between the first suction passage and the second suction passage.

8. The scroll compressor of claim 7, wherein a sealing member is provided between an end surface of the first suction passage and an end surface of the second suction passage, the end surface of the second suction passage facing the end surface of the first suction passage, and wherein an axial center of the sealing member is eccentric with respect to the axial center of the first suction passage or the axial center of the second suction passage.

9. The scroll compressor of claim 1, wherein an axial center of the first suction passage and an axial center of the second suction passage are aligned with each other, and wherein the first suction passage has an inner diameter smaller than an inner diameter of the second suction passage to thereby define a valve seat surface at an end surface of the first suction passage.

10. The scroll compressor of claim 1, wherein the suction passage opening and closing valve comprises:

a valve body portion having a plate shape and configured to open and close the suction passage, and a valve guide portion extending in the axial direction from the valve body portion, and wherein the valve guide portion has an annular shape and is defined at an edge of the valve body portion.

11. The scroll compressor of claim 10, wherein the valve guide portion has an outer diameter less than or equal to an outer diameter of the valve body portion.

12. The scroll compressor of claim 10, wherein the valve guide portion includes at least one communication groove defined at an end surface of the valve guide portion, the valve guide portion extending between an outer circumferential surface and an inner circumferential surface of the valve guide portion.

13. The scroll compressor of claim 1, wherein the suction passage opening and closing valve has opposite side surfaces extending in the axial direction and having a flat plate shape.

14. The scroll compressor of claim 1, wherein the suction passage opening and closing valve has a refrigerant accommodating space that is recessed at a first side surface of the suction passage opening and closing valve, the first side surface of the suction passage opening and closing valve being opposite, in the axial direction, to a second side surface of the suction passage opening and closing valve that faces the refrigerant suction pipe.

15. The scroll compressor of claim 1, further comprising an elastic member disposed between the suction passage opening and closing valve and the second suction passage, the second suction passage facing the suction passage opening and closing valve and configured to support the suction passage opening and closing valve in a closing direction.

16. A scroll compressor comprising:

a casing;

a main frame provided in the casing;

a fixed scroll having (i) a fixed end plate coupled to the main frame, (ii) a fixed wrap defined at a first side surface of the fixed end plate, and (iii) a discharge port defined through the fixed end plate at a side of the fixed wrap;

an orbiting scroll having (i) an orbiting end plate located between the main frame and the fixed scroll, and (ii) an orbiting wrap defined at a side surface of the orbiting end plate, the orbiting wrap being configured to engage with the fixed wrap to thereby define a compression chamber in engagement with the fixed wrap;

a discharge cover defining a discharge space that accommodates an outlet of the discharge port, the discharge cover being coupled to a second side surface of the fixed end plate opposite to the first side surface of the fixed end plate;

a refrigerant suction pipe coupled to the fixed scroll through the casing in a radial direction;

a suction passage in fluid communication with the refrigerant suction pipe and the compression chamber; and a suction passage opening and closing valve provided inside the suction passage and configured to slide in an axial direction to thereby selectively open or close the suction passage, wherein the suction passage comprises:

a first suction passage defined at the fixed scroll and connected to the refrigerant suction pipe; and a second suction passage defined at the fixed scroll and having first and second ends, the first end being in fluid communication with the first suction passage, and the second end being in fluid communication with the compression chamber, and wherein the suction passage opening and closing valve is inserted into the second suction passage and configured to slide in the axial direction.

17. The scroll compressor of claim 16, wherein the fixed scroll includes a suction guide protrusion extending from the fixed end plate toward the discharge cover in the axial direction, and wherein at least part of the first suction passage is defined through the suction guide protrusion.

18. The scroll compressor of claim 17, wherein the suction guide protrusion is spaced apart from a side surface of the discharge cover.

19. The scroll compressor of claim 16, wherein the first suction passage has an inner diameter smaller than an inner diameter of the second suction passage to thereby define a valve seat surface at an end surface of the first suction passage.

20. The scroll compressor of claim 16, wherein the second suction passage is partially defined at an inner circumferential surface of a fixed side wall portion of the fixed scroll, the second suction passage being recessed in the radial direction, and wherein the fixed side wall portion includes a valve stopper coupled to an end of the inner circumferential surface and configured to support the suction passage opening and closing valve in the axial direction.

* * * * *